US010882161B2

(12) United States Patent
Hopey

(10) Patent No.: US 10,882,161 B2
(45) **Date of Patent: *Jan. 5, 2021**

(54) FLOATING JAW ASSEMBLY FOR USE WITH MACHINIST VISES

(71) Applicant: Timothy Hopey, Valencia, PA (US)

(72) Inventor: Timothy Hopey, Valencia, PA (US)

( * ) Notice: Subject to any disclaimer, the term of this patent is extended or adjusted under 35 U.S.C. 154(b) by 161 days.

This patent is subject to a terminal disclaimer.

(21) Appl. No.: 16/105,063

(22) Filed: Aug. 20, 2018

(65) Prior Publication Data

US 2019/0054597 A1 Feb. 21, 2019

Related U.S. Application Data

(60) Continuation-in-part of application No. 15/817,324, filed on Nov. 20, 2017, now abandoned, which is a (Continued)

(51) Int. Cl.
*B25B 1/24* (2006.01)
*B25B 1/10* (2006.01)
(Continued)

(52) U.S. Cl.
CPC ..... *B25B 1/2452* (2013.01); *B25B 1/103* (2013.01); *B25B 1/125* (2013.01); *B25B 1/2478* (2013.01); *B25B 1/02* (2013.01); *B25B 1/04* (2013.01)

(58) Field of Classification Search
CPC ... B25B 1/2442; B25B 1/2452; B25B 1/2478; B25B 1/2489
See application file for complete search history.

(56) References Cited

U.S. PATENT DOCUMENTS 2,176,608 A * 10/1939 Marsilius ..... B25B 1/103 269/146
2,662,433 A * 12/1953 Braun ..... B23Q 3/061 269/153

(Continued)

*Primary Examiner* — Tyrone V Hall, Jr.
(74) *Attorney, Agent, or Firm* — Barbara E. Johnson, Esq.

(57) ABSTRACT

An improved floating jaw assembly to a machinist vise assembly capable of holding a plurality of individual workpieces, the vise assembly generally including a base with a way or ways, a fixed jaw mounted on the ways, at least one movable jaw slidably mounted on the ways to move toward and away from the fixed jaw on a longitudinal axis in such a manner that at least one workpiece can be securely held between the fixed jaw and the at least one movable jaw, and a mechanism for moving the movable jaw toward and away from the fixed jaw to clamp and unclamp workpieces. The floating jaw assembly includes at least one floating jaw plate attached to the vise assembly with means for adjustable movement of the floating jaw plate(s) along the longitudinal axis of the vise assembly and for articulated movement of the floating jaw plate(s) in a plane substantially parallel to the base of the vise assembly and about an axis perpendicular to the longitudinal axis of the vise assembly so that the floating jaw plates can, in cooperation with adjoining jaws or plates, adjust to and securely hold workpieces. In addition, the floating jaw assembly includes a means of forcing the at least one floating jaw plate downward and securely against the ways of the vise assembly.

12 Claims, 26 Drawing Sheets

Related U.S. Application Data division of application No. 14/603,092, filed on Jan. 22, 2015, now Pat. No. 9,849,565.

(60) Provisional application No. 62/547,385, filed on Aug. 18, 2017, provisional application No. 61/930,085, filed on Jan. 22, 2014, provisional application No. 62/011,183, filed on Jun. 12, 2014, provisional application No. 62/080,683, filed on Nov. 17, 2014.

(51) Int. Cl.

| | |
|---|---|
| ***B25B 1/12*** | (2006.01) |
| ***B25B 1/04*** | (2006.01) |
| ***B25B 1/02*** | (2006.01) |

(56) References Cited

U.S. PATENT DOCUMENTS

| | | | | | |
|---|---|---|---|---|---|
| 4,241,906 | A * | 12/1980 | Cole | B25B 1/02 | 269/43 |
| 4,423,860 | A * | 1/1984 | Windstrup | B25B 1/2489 | 269/180 |
| 4,930,760 | A * | 6/1990 | Mirkovic | B23Q 3/061 | 269/134 |
| 5,022,636 | A * | 6/1991 | Swann | B25B 1/103 | 269/154 |
| 5,330,167 | A * | 7/1994 | Plumb | B25B 1/06 | 269/153 |
| 6,062,553 | A * | 5/2000 | Strehl | B25B 1/2452 | 269/153 |
| 6,105,948 | A * | 8/2000 | Young | B25B 1/103 | 269/244 |
| 6,896,249 | B1 * | 5/2005 | Ferrara | B25B 1/12 | 269/138 |
| 9,849,565 | B2 * | 12/2017 | Hopey | B25B 1/2452 | |
| 2012/0205852 | A1 * | 8/2012 | Coleman | B25B 1/2478 | 269/278 |

* cited by examiner

FLOATING JAW ASSEMBLY FOR USE WITH MACHINIST VISES

CROSS-REFERENCE TO RELATED APPLICATIONS

This nonprovisional patent application claims priority to U.S. Provisional Application No. 62/547,385 titled FLOATING JAWS filed Aug. 18, 2017 and also is a Continuation in Part of U.S. patent application Ser. No. 15/817,324 filed Nov. 20, 2017 titled FLOATING JAW ASSEMBLY FOR USE WITH MACHINIST VISES, which is a Divisional of U.S. patent application Ser. No. 14/603,092 filed Jan. 22, 2015 which issued as U.S. Pat. No. 9,849,565 which issued on Dec. 26, 2017 and which claim the benefit of and claim priority to U.S. Provisional Application No. 61/930,085 filed on Jan. 22, 2014 and U.S. Provisional Application No. 62/011,183 filed Jun. 12, 2014 and U.S. Provisional Application No. 62/080,683 filed on Nov. 17, 2014 all collectively incorporated by reference herein in their entirety.

FIELD OF THE INVENTION

The present invention relates to the precision machining of workpieces and, in particular, to the use of an additional floating jaw assembly to expand the number of workpieces that can be held and machined as part of a machinist vise.

BACKGROUND OF THE INVENTION

Precision machinist or machining vises, also known as workholding vises, are well known and generally include various complex machining vise assemblies with one or two movable jaws that move the one or two movable jaws toward and away the opposite faces of one fixed jaw by turning one lead-screw. This movement enables the movable jaw(s) to hold two or less workpieces in a row per each movable jaw. As such, a dual movable jaw vise can hold a maximum of four or less workpieces. To expand the number of workpieces that can be held by the vise, some efforts have been undertaken to interpose one or more intermediary jaws between one fixed jaw and one movable jaw. These intermediary jaws have limitations, however, insofar as they are not able to shift or articulate in a plane parallel to the base of the vise and they offer no means to force the intermediary jaw(s) against the base or ways of the vise. As a result of these limitations, the known intermediary jaws do not allow the secure clamping of unequal, uneven or various shaped workpieces. The known intermediary jaws also do not allow the repeatable location of workpieces in what is known as the Z direction, nor do they add vibration damping when machining workpieces. As such, they offer little or no value as a workholding device.

SUMMARY OF THE INVENTION

The present invention relates to an improvement to a conventional machining or machinist vise, also known as a workholding vise. The conventional vise is designed to precisely hold two or less workpieces between a fixed jaw and one movable jaw. The movable jaw may be moved toward and away from the fixed jaw longitudinally along the vise way by turning one lead-screw and thereby clamping and unclamping the workpieces there between. The invention presented herein is a floating jaw assembly which improves the vise by allowing it to hold more than two workpieces per each floating or movable jaw. In particular, each floating jaw allows for the vise to hold and clamp up to two additional workpieces per every floating jaw. The floating jaw interacts with adjoining jaws, in the same manner as the fixed and moveable jaws, to hold and clamp workpieces. The quantity of floating jaws and, as a result, the quantity of additional workpieces that can be held by the vise is dependent upon various factors including, but not limited to, the size of workpieces that are to be held, the allowable distance that the movable jaw can be moved away from the fixed jaw and the size of cutting tools that are required to machine the workpieces. The floating jaw assembly of the present invention succeeds in performing the aforementioned holding of numerous workpieces by incorporating novel means that allow each floating jaw to move freely in various directions so that the floating jaw can shift and articulate to securely clamp unequal, uneven and various shaped workpieces. More specifically, each floating jaw can (i) move along the longitudinal axis of the vise, (ii) articulate about an axis perpendicular to the longitudinal axis of the vise, and (iii) shift sideway in a plane parallel to the base of the vise. Additionally, the floating jaw assembly of the present invention includes novel force-down mechanisms to force each floating jaw securely and squarely against the ways of the vise so as to repeatably locate each floating jaw in a so-called +/−Z direction, i.e., a direction perpendicular to the longitudinal axis of the vise, when clamping workpieces and also to provide desired vibration damping as each floating jaw rests securely on the way of the vise.

DETAILED DESCRIPTION OF THE EMBODIMENTS

Figure 1:
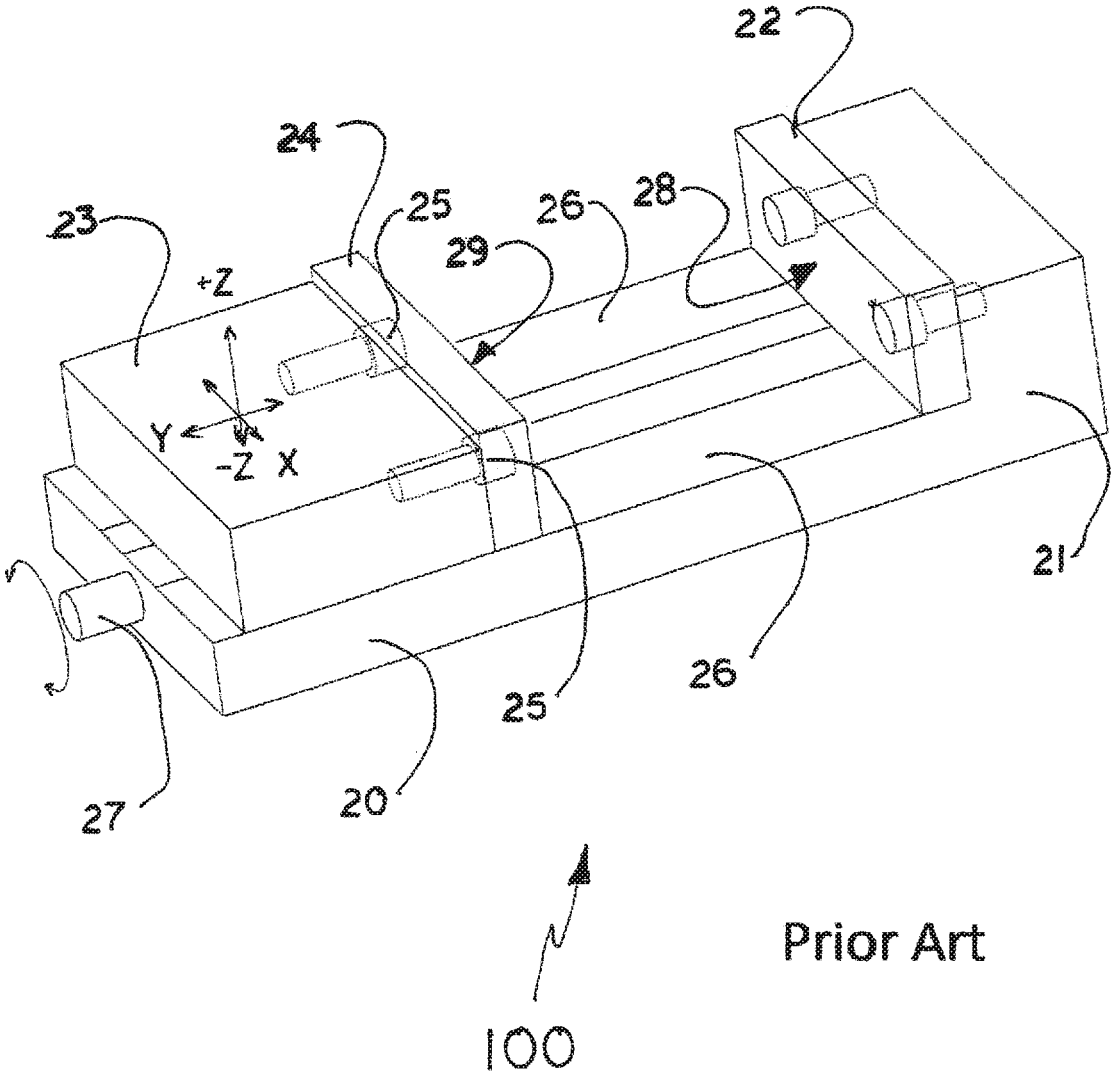
Prior Art FIG. 1
FIG. 1 is an isometric view of a typical workholding machinist vise.

FIG. 1 shows a typical workholding machinist vise 100 in basic form. The present invention employs the multiple degrees of freedom and various securing abilities inherent to the vise of FIG. 1, as described herein. The vise has a base 20 with precision ways 26 that supports fixed jaw 21 and movable jaw 23. For this application, ways 26 is assumed to be a flat datum where all jaws and workpieces can be referenced. Further, typical vises make use of one or more ways therefore singular way or plural ways are considered the same. Fixed jaw plate 22, with jaw plate face 28, is fixed to fixed jaw 21, and movable jaw plate 24, with jaw plate face 29, is fixed to movable jaw 22 by bolts 25. The movable jaw 23 and items affixed thereto can be moved longitudinally in the +/−Y direction along the ways 26 by turning lead-screw 27 to clamp or unclamp workpieces between fixed jaw plate 22 and movable jaw plate 24. Further, the movable jaw and items affixed thereto ideally can shift in the +/−X direction parallel to the vise ways 26 and articulate around an inherent Z axis, perpendicular to the longitudinal axis of ways 26 to accommodate clamping of workpieces. Fixed jaw plate 22 and movable jaw plate 24 can have a recessed edge or cut-outs at the upper portions of plate faces 28 and 29, respectively, to assist in securely holding workpieces. Additionally, the movable jaw 23 and items affixed thereto are forced in the −Z direction and thus held securely and relatively parallel and perpendicular to the ways 26 of the vise 100 when clamping workpieces. This secure holding of the movable jaw against ways 26 is necessary because of the small tolerances associated with precision machining operations. More specifically, it is common that parts are made that cannot vary more than the thickness of a human hair or less from part to part over a production run of a multitude of parts. Thus, when clamping a workpiece, the movable jaw 23 has to rest repeatably and securely against the ways 26 or some other stationary surface so that all the resulting parts will have as very near as possible the same size and tolerances.

As discussed in the Background Section above, past efforts have been undertaken to include intermediary jaws between movable jaw 23 and fixed jaw 21 of vise 100. Such intermediary jaws are intended to increase the number of workpieces that can be held in a production run. These past efforts have had several primary drawbacks. First, such efforts have included intermediary jaws that do not shift in the +/−X direction parallel to ways 26 and do not articulate around an inherent Z axis perpendicular to the longitudinal axis of ways 26 and thus do not offer secure clamping of various workpieces. In addition, past efforts have included intermediary jaws that are not forced down to rest securely against the ways 26 of base 20 of vise 100. As a result, tolerances are not maintained for multiple workpieces and no added vibration damping is offered. The present invention addresses these past drawbacks and provides novel floating jaw plate(s) that have the desired ranges of motion and mechanisms to force floating jaw plate(s) securely against ways 26 and to securely hold and allow for precision machining of multiple workpieces.

Figure 2:
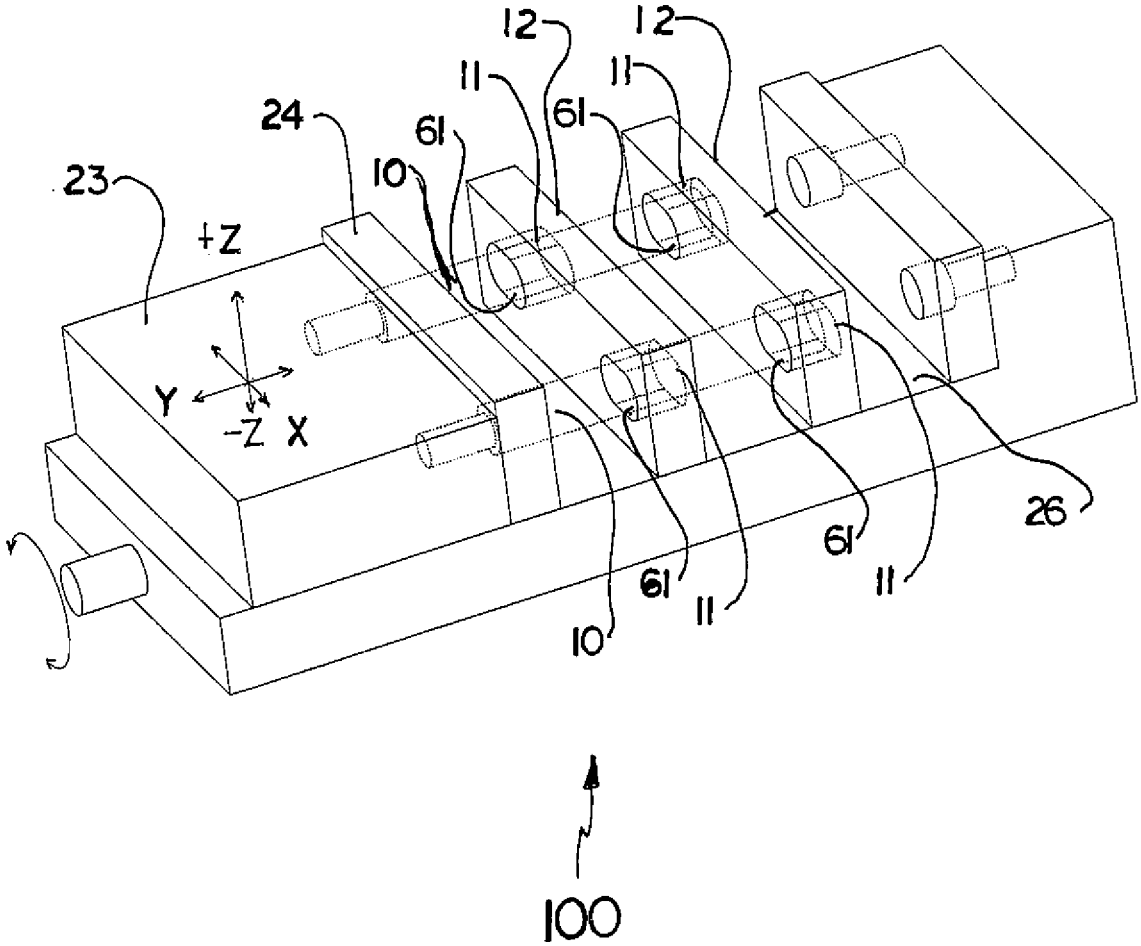
FIG. 2 is an isometric view of a typical workholding machinist vise including a two mounting pin floating jaw assembly according to one embodiment of the present invention.
Figure 3:
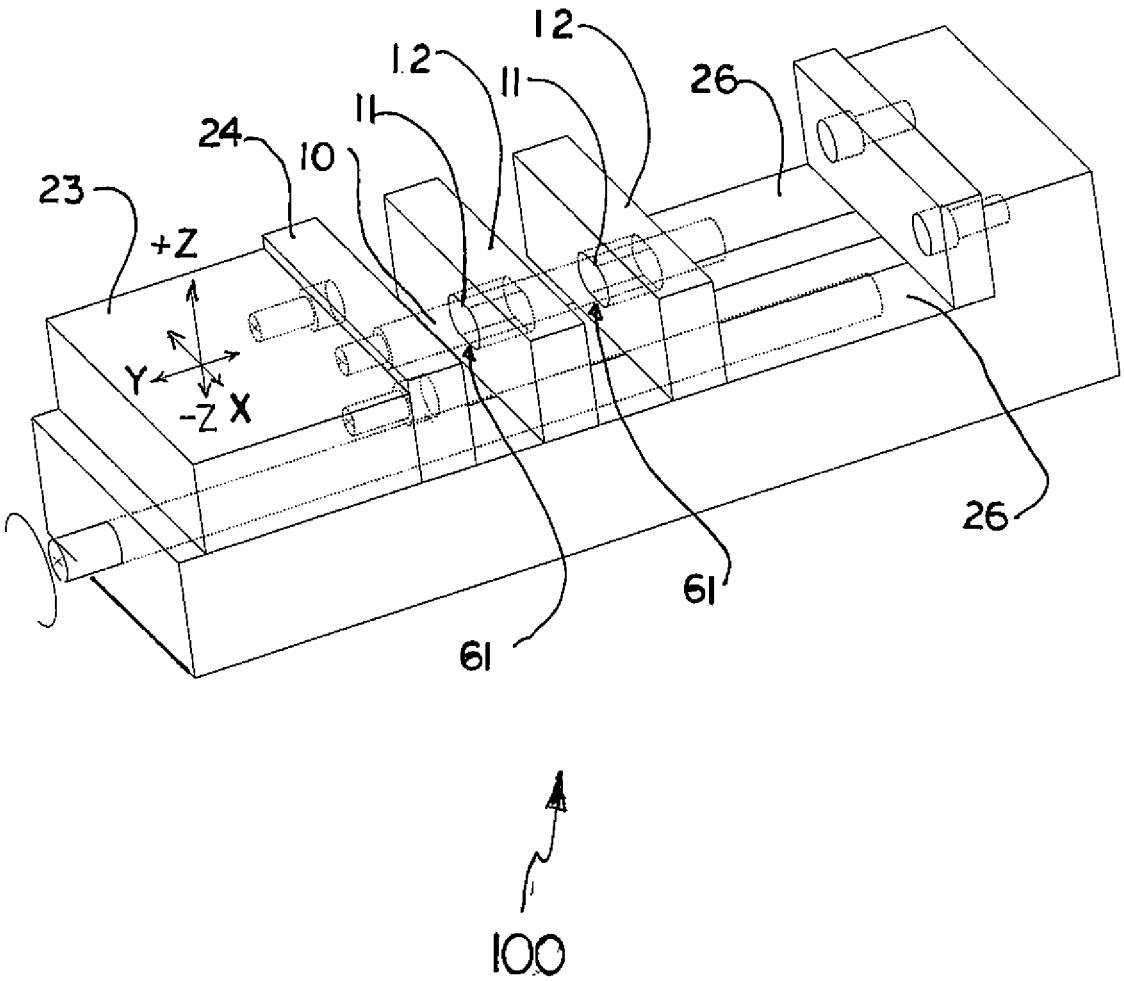
FIG. 3 is an isometric view of a typical workholding machinist vise including a single mounting pin floating jaw assembly according to another embodiment of the present invention.

In one embodiment of the present invention, as shown in FIG. 2, two threaded mounting pins 10 extend thru two openings 11 in one or more floating jaw plates 12 and replace bolts 25 of FIG. 1 to affix movable jaw plate 24 to movable jaw 23. Floating jaw plates 12, along with mounting pins 10 (and related elements of the present invention in all embodiments) can be added as an accessory to an existing vise 100, or the various embodiments of the present invention can be built as part of vise 100. As an alternative embodiment, a single mounting pin 10 and opening 11 can be utilized as shown in FIG. 3. The cooperation of mounting pin 10 and opening 11, whether with one or two mounting pins used in the invention, is detailed in FIGS. 4 and 5. Floating jaw plates 12 can be removed from mounting pins 10 and additional floating jaw plates 12 can be added to the assembly, as needed, to accommodate the number of workpieces.

Referring again to FIGS. 2-5, the means by which the present invention allows for sideway and articulated movement of the floating jaw(s) 12, as well as forced contact of the floating jaw(s) 12 against ways 26 is shown by the manner in which (i) a mounting pin 10 is mounted to movable jaw plate 24 and is affixed to movable jaw 23, and (ii) mounting pin 10 extends thru an opening 11 in floating jaw(s) 12. Opening 11 is further detailed in FIG. 4.

Figure 5:
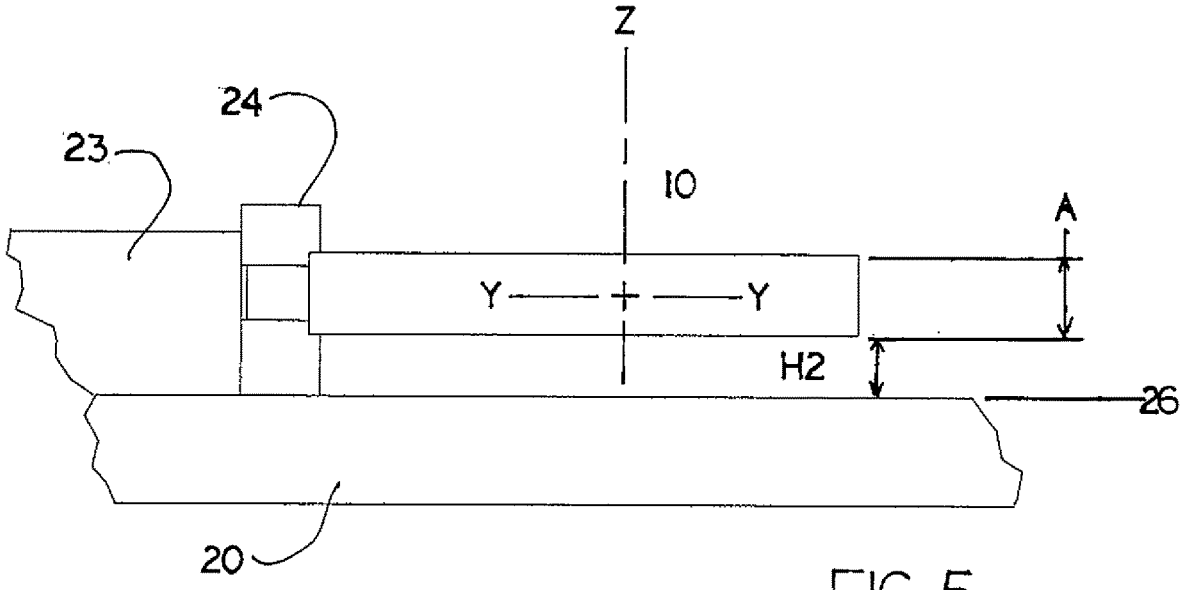
FIG. 5 is a segmented side view of a mounting pin fitted to the movable jaw of the vise as shown in FIG. 3.
Figure 4:
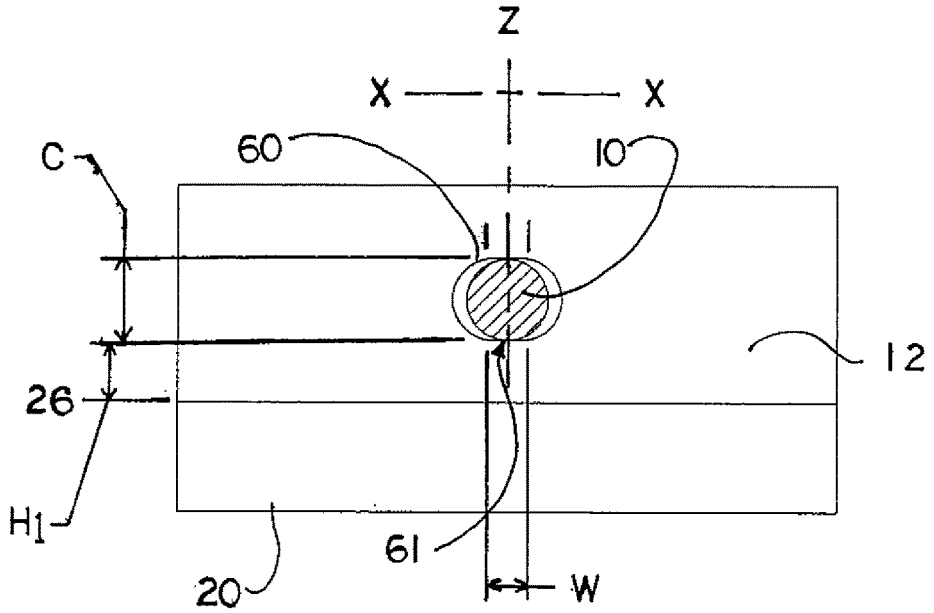
FIG. 4 is a front view of a floating jaw plate in the floating jaw assembly shown in FIG. 2, with an opening resting flatly on the vise way and showing a mounting pin in end view positioned through the opening.

FIG. 4 shows a front view of floating jaw plate 12 resting flatly on vise ways 26 and having opening 11 shown with mounting pin 10 in end view fitting through opening 11 and resting on flat surface 61. Preferably, the width of opening 11 is greater than the height of opening 11. FIG. 5 shows a side view of mounting pin 10. Dimension H1 and H2 in FIGS. 4 and 5 are the distances from the vise ways 26 to the flat surface 61 of opening 11 and to the bottom edge of the mounting pin 10 respectively when clamping workpieces in a vise in accordance with the present invention. The ability of mounting pin 10 to apply sufficient −Z directed force to flat surface 61 of floating jaw plate 12 (which, in turn, forces floating jaw plate 12 securely and relatively parallel and perpendicular against ways 26) increases as dimension H1 of FIG. 4 becomes closer to being equal to but remaining greater than dimension H2 of FIG. 5. Further, maintaining consistency of H1 and H2 enhances the ability of mounting pin 10 to apply sufficient −Z directed force to flat surface 61 of multiple floating jaw plates 12, which, in turn, forces floating jaw plates 12 securely and relatively parallel and perpendicular against ways 26. The −Z direction in FIGS. 1-3 has similar orientation in the remaining Figures.

Dimension W of FIG. 3 corresponds to the length of flat surface 61 as adapted to opening 11 and extending in the +/−X direction. As shown in FIGS. 4 and 5, the elongated width of opening 11 is greater than the width of the corresponding mounting pin to allow the floating jaw 12 to freely move in +/−X direction parallel to the plane of ways 26 in vise 100 and articulate around a Z axis perpendicular to the longitudinal axis of vise 100 because the flat surface 61 can freely slide against the mounting pin 10. This is in contrast to the lack of freedom of such movement that results from a round mounting pin 10 that snugly fits through a round hole as utilized in prior art designs. Flat surface 61 is relatively parallel with vise ways 26 when clamping workpieces. Dimension C must be greater than diameter A of mounting pin 10 in FIG. 5 to allow mounting pin 10 to be inserted freely through opening 11. In a preferred embodiment, mounting pin 10 is round. However, mounting pin 10 and opening 11 and flat surface 61 can be most any shapes and or means as long as said shapes and means when communicating with each other, as workpieces are clamped, allow the floating jaw plate to move in the +/−X and Y directions and articulate around some Z axis and force the floating jaw plate in the −Z direction firmly against the ways 26 of the vise when clamping workpieces. For example, but without limitation, the sides of opening 10 can be square and the upper portion can be curved, provided that flat surface 61 interacts with mounting pin 10 to allow for the movements described above.

Figure 6:
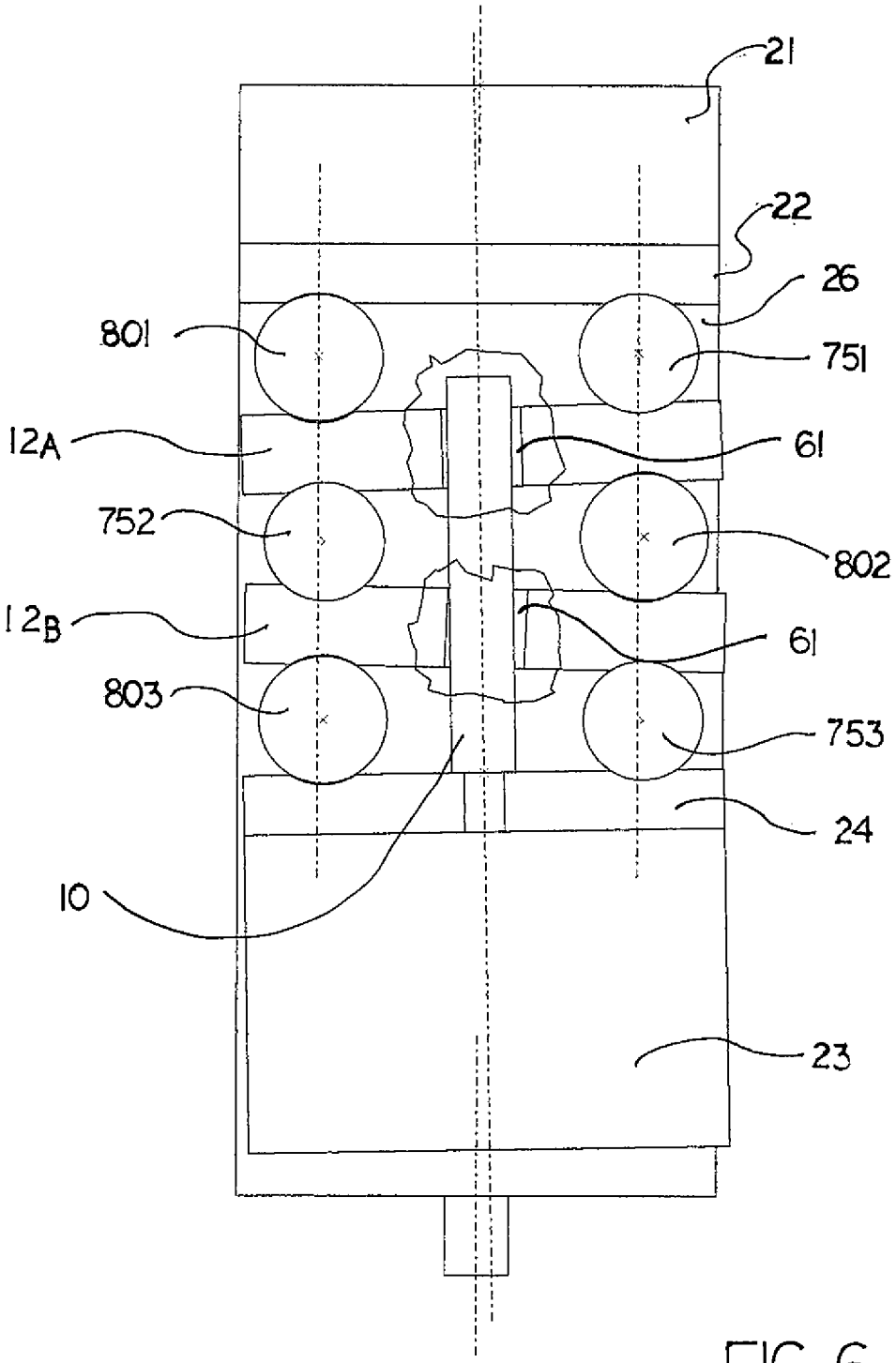
FIG. 6 is a top view of a conventional machining vise using the floating jaw assembly of the present invention to clamp six varied sized workpieces.

FIG. 6 is a top view of a conventional machining vise using the floating jaw assembly of the present invention to clamp six round workpieces of varying sizes. The workpieces 801, 802, 803 are a larger diameter than workpieces 751, 752, 753. In practice, it is understood that when having to hold and machine a multitude of the same workpiece, the multitude of those workpieces vary slightly in size, and, therefore, the workholding device must accommodate the variance in sizes. The differences in diameters are exaggerated in FIG. 6 to aid in the visual teaching of the art.

Fixed jaw 21, with attached fixed jaw plate 22, are fixed to the vise 100 and do not move. When holding odd shaped workpieces that do-not have two parallel sides to clamp against, it is customary to machine a matching female pocket of the odd shape directly into the jaw plates to hold the odd shaped workpiece. In FIG. 6, fixed jaw plate 22, movable jaw plate 24 and floating jaw plates 12A and 12B illustrate female pockets in the jaws that match the smaller diameter workpieces 751, 752, 753. As shown in an exaggerated manner in FIG. 6, workpiece 801 is a larger diameter than workpiece 751; therefore, when floating jaw plate 12A moves in the Y direction to clamp workpieces 801 and 751 between fixed jaw plate 22 and floating jaw plate 12A, floating jaw plate 12A must articulate around an axis perpendicular to the longitudinal axis of the vise ways 26 and shift in the X direction (i.e., in a sideway direction parallel to the base of the vise) to accommodate the clamping of two different sized workpieces. To further exaggerate the varying directions of articulation and X direction movement for each floating jaw plate, as shown in FIG. 6, the larger diameter workpiece 802 is positioned in line with workpiece 751 and workpiece 752 is mounted in line with workpiece 801; thus forcing floating jaw plate 12B to articulate and shift in the X direction differently and independently of floating jaw plate 12A when clamping workpieces 752 and 802 between floating jaw plates 12A and 12B. At the same, movable jaw 23 with attached movable jaw plate 24 must also articulate and shift in the X direction independently when workpieces 803 and 753 are clamped between movable jaw plate 24 and floating jaw plate 12A.

Therefore, as shown in an a segmented, exaggerated manner in FIG. 6, flat surface 61 of opening 11 incorporated into floating jaw plates 12 must be of sufficient length in the X direction so that mounting pin 10 does not inhibit the freedom of motion needed for floating jaw plates of the invention presented herein to adapt to and clamp varying sized workpieces.

Figure 7:
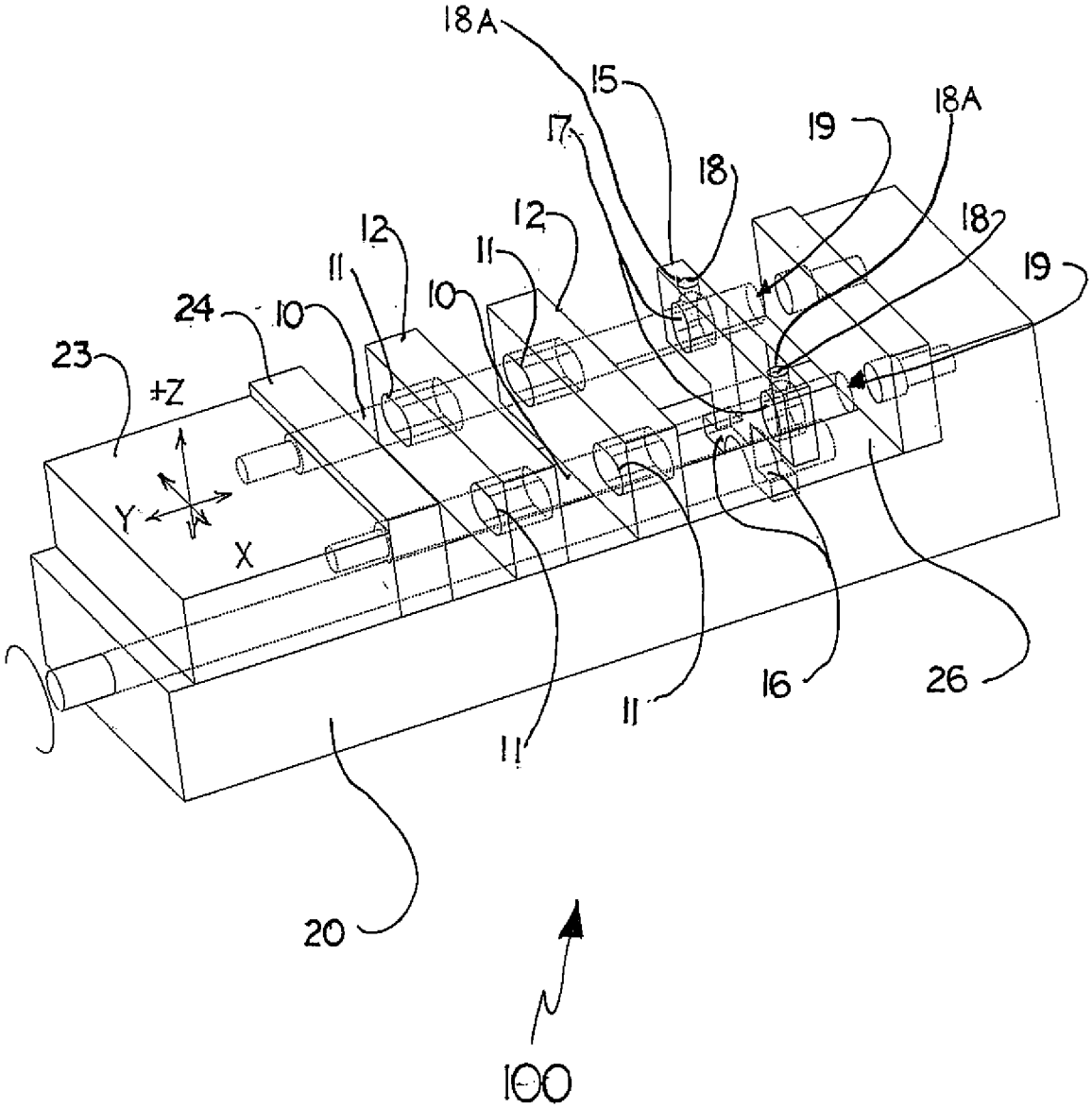
FIG. 7 is an isometric view of a typical workholding machinist vise including a two mounting pin floating jaw assembly according to FIG. 2 and showing an embodiment of the present invention where a force-down mechanism includes a bracket with adjusting screws to secure and release the free end of the mounting pins.

In other embodiments, the present invention can include various force-down mechanisms that force the free end 19 of pin 10 in the −Z direction and thus force the floating jaws 12 securely against the base or ways 26 of vise 100. These various force-down mechanisms are shown in FIGS. 7-14B. It is possible, though, for the present invention to operate without a force-down mechanism at the free end 19 of mounting pin 15 and associated with the fixed jaw plate 12. Additionally, the present invention anticipates and is not limited to any means that secure floating jaw plate 12 to any Z datum available. One embodiment utilizing a force-down mechanism is shown in FIG. 7, which adds to the features of FIG. 2 a bracket 15 comprised of openings 17 of greater diameter than pins 10 to allow pin to move in the −Z direction with respect to bracket 15 and ears 16 that interact with the underside 26A of the way 26 so as to be pulled up to a stop in the +Z direction when tightening screws 18 are engaged. In particular, screws 18 are tightened in a threaded opening 18A at top of bracket 15 after clamping workpieces between jaws, which, in turn, forces the free end of mounting pins 10 in the −Z direction and thus aids in forcing floating jaw plates 12 against ways 26. At the conclusion of machining workpieces, screws 18 are loosened before unclamping workpieces to eliminate the −Z directed force on pin(s) 10 and to allow freedom to move movable jaw 23 and affixed items longitudinally in the Y direction. Bracket 15 with ears 16 allow for varying positioning in the +/−Y direction to accommodate various sizes of workpieces and thus various positions of the free pin end 19. The present invention does not limit a multitude of means to connect said bracket 15 to any stationary portion of the vise.

Figure 8:
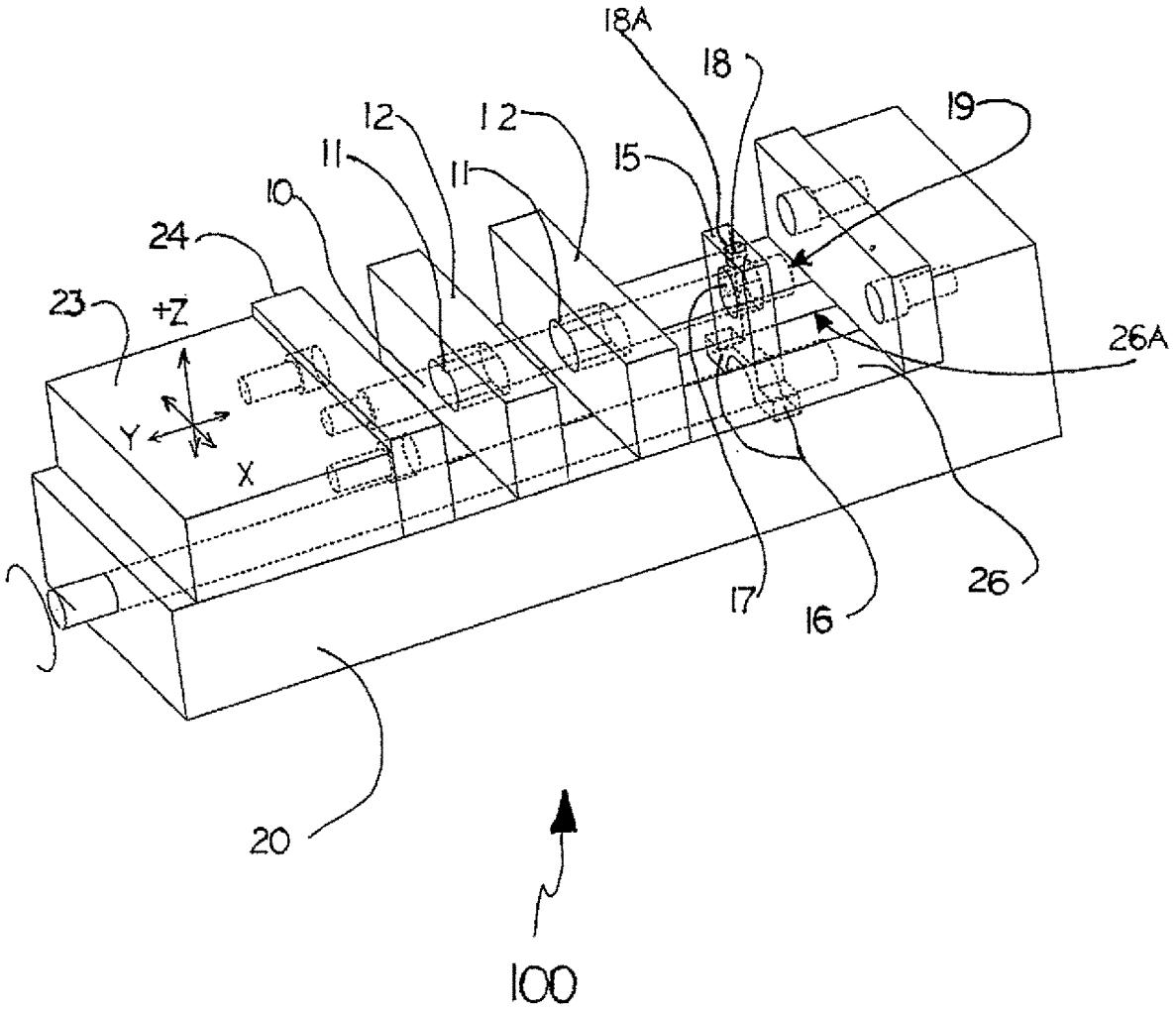
FIG. 8 is an isometric view of a typical workholding machinist vise including a single mounting pin floating jaw assembly according to FIG. 3 and showing an embodiment of the present invention where the force-down mechanism includes a bracket with adjusting screw to secure and release the free end of the mounting pins.

FIG. 8 shows an embodiment similar to that depicted in FIG. 7, but where only one screw 18 is utilized with opening 18A and bracket 15 to secure mounting pin 10.

Figure 9:
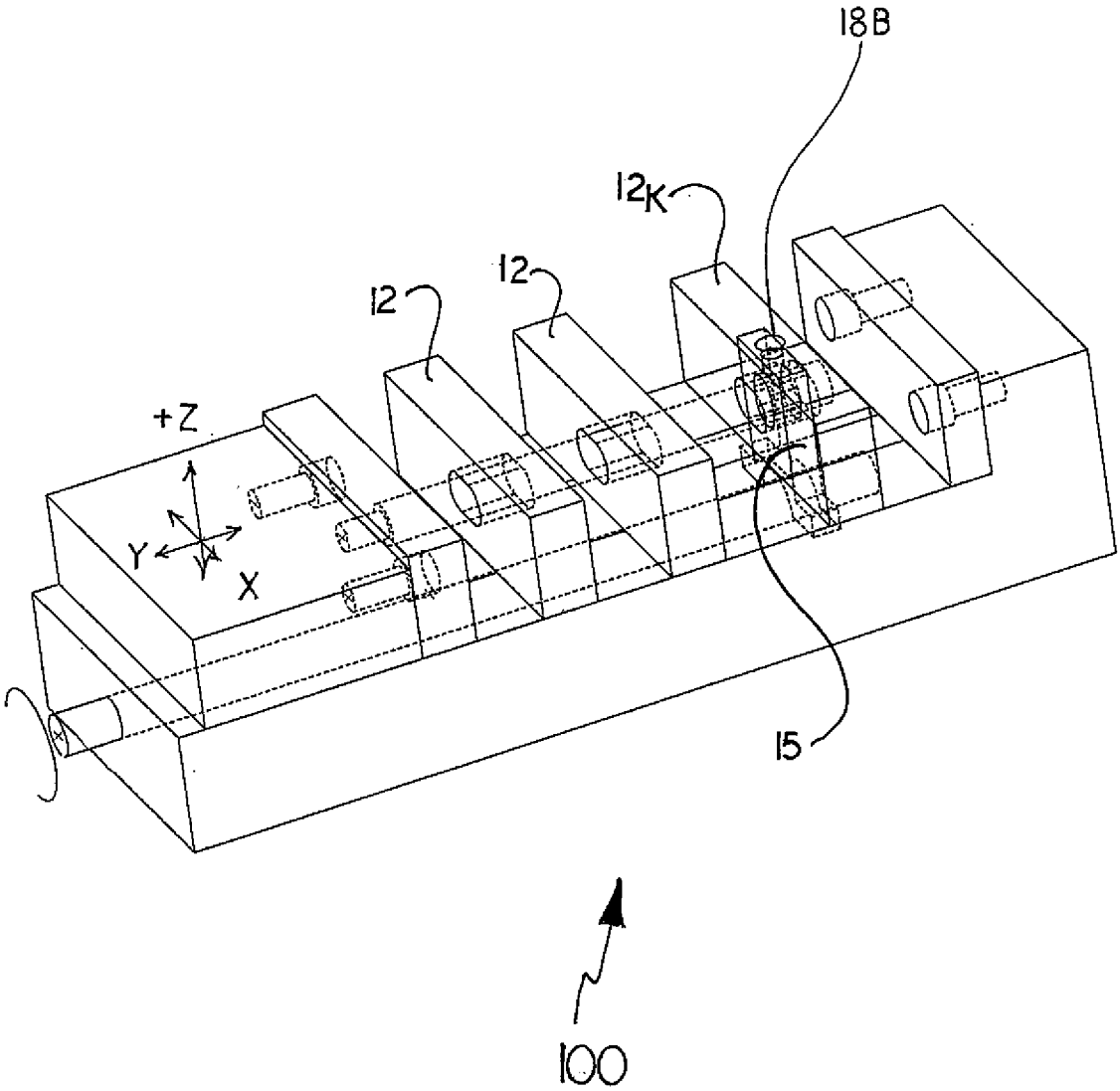
FIG. 9 is an isometric view of a typical workholding machinist vise including a single mounting pin floating jaw assembly according to FIG. 3 and showing another embodiment of the present invention where the force-down mechanism includes a bracket screw assembly fitted into a floating jaw.

FIG. 9 shows another embodiment of a screw/bracket force-down mechanism, with floating jaw plate 12K having a machined cavity to receive bracket 15. This embodiment hides bracket 15 from the work area. The top of the floating jaw plate includes opening 18B at the top, which allows screw 18 to access threaded opening 18A at the top of bracket 15.

Figure 10:
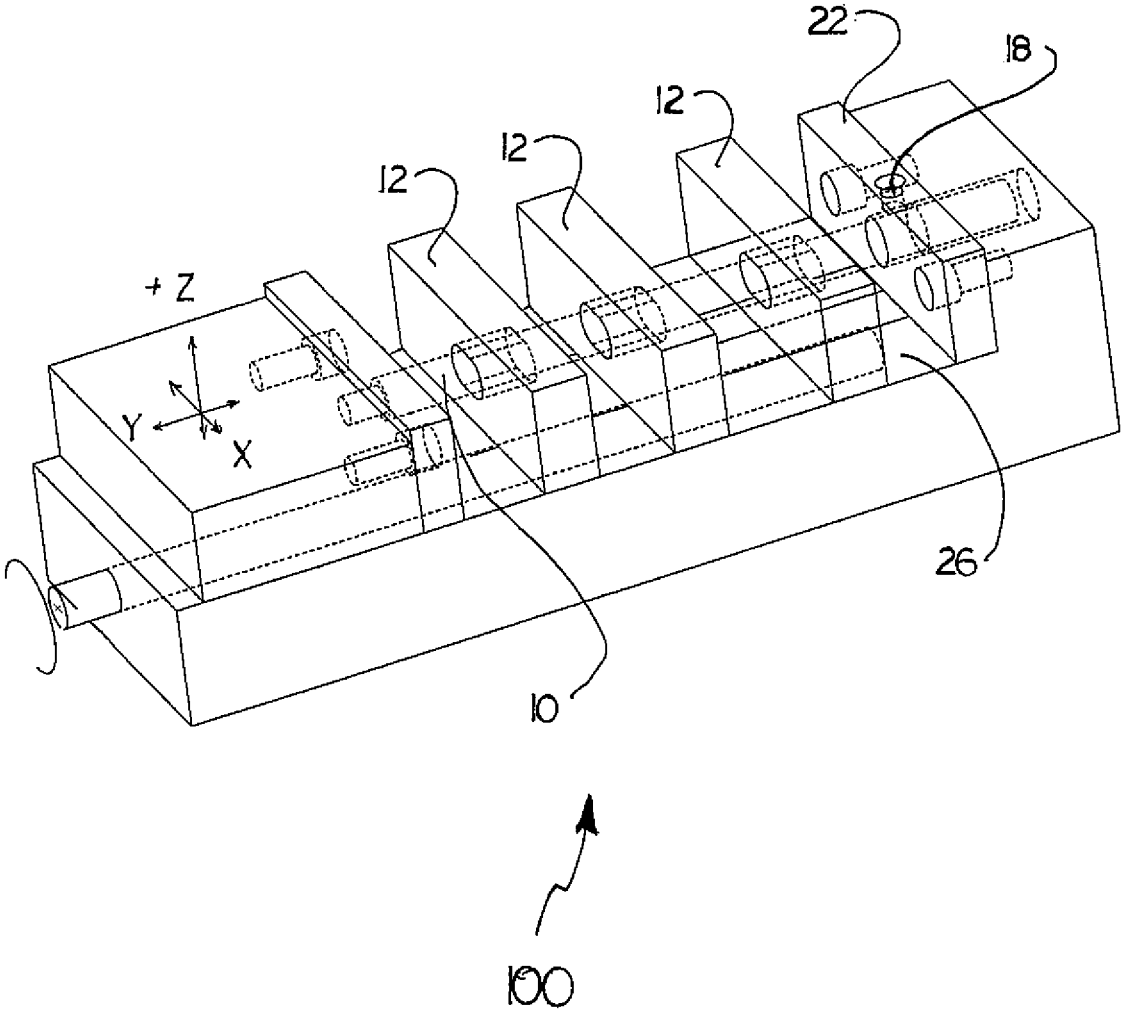
FIG. 10 is an isometric view of a typical workholding machinist vise including a single mounting pin floating jaw assembly according to FIG. 3 and showing another embodiment of the present invention where the force-down mechanism includes an adjusting screw threaded into the fixed jaw plate to secure and release the free end of mounting pin.

FIG. 10 shows another embodiment of a screw force-down mechanism, using one screw 18 that is positioned and threaded into fixed jaw plate 22 so to tighten and force free end of mounting pin 10 in −Z direction. This, again, aids in forcing floating jaw plates 12 against ways 26.

Figure 11:
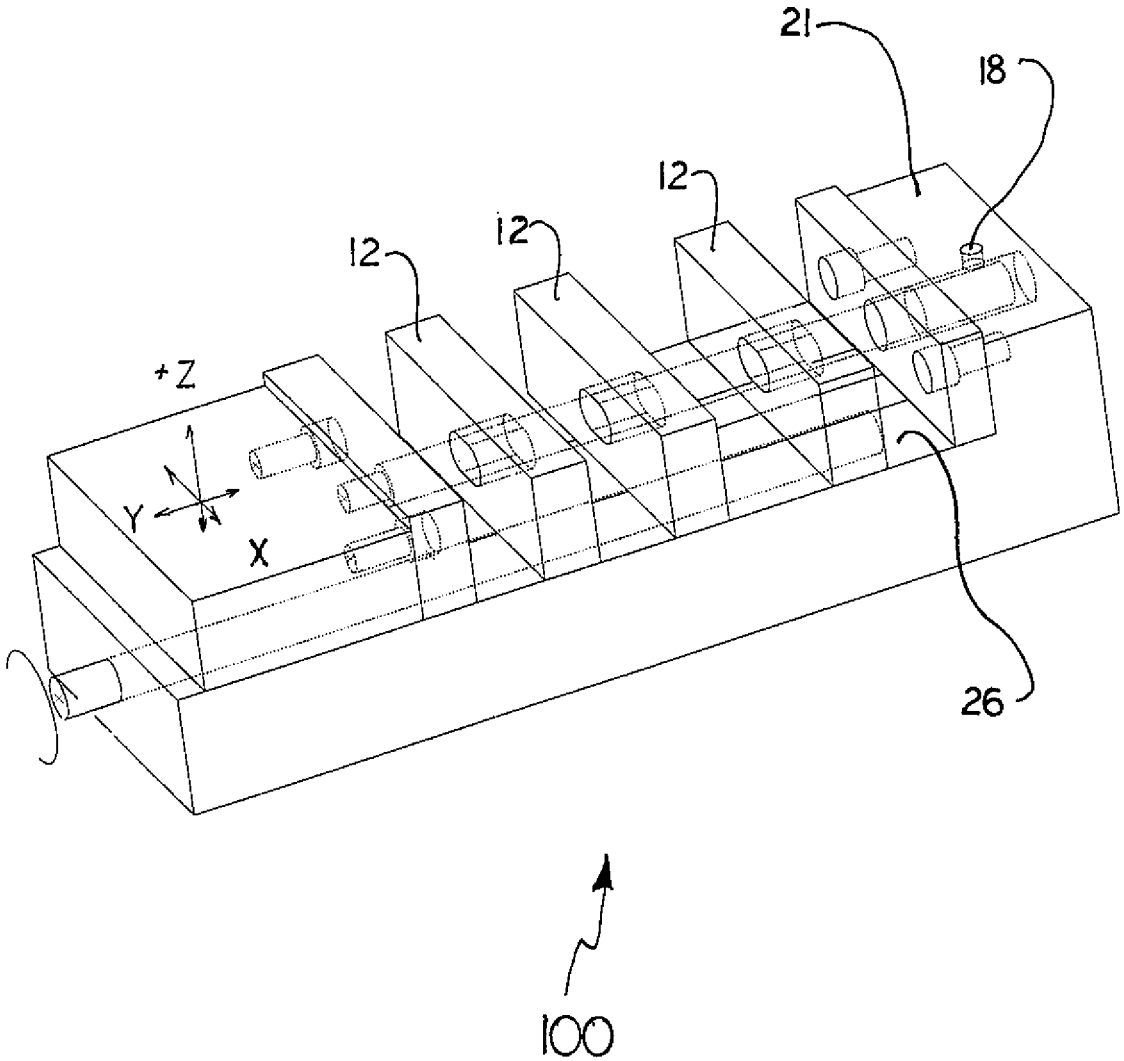
FIG. 11 is an isometric view of a typical workholding machinist vise including a single mounting pin floating jaw assembly according to FIG. 3 and showing another embodiment of the present invention where the force-down mechanism includes an adjusting screw threaded into the fixed jaw to secure and release free end of the mounting pin.

FIG. 11 is a further embodiment of a screw force-down mechanism in which threading screw 18 interacts with fixed jaw 21.

Figure 12:
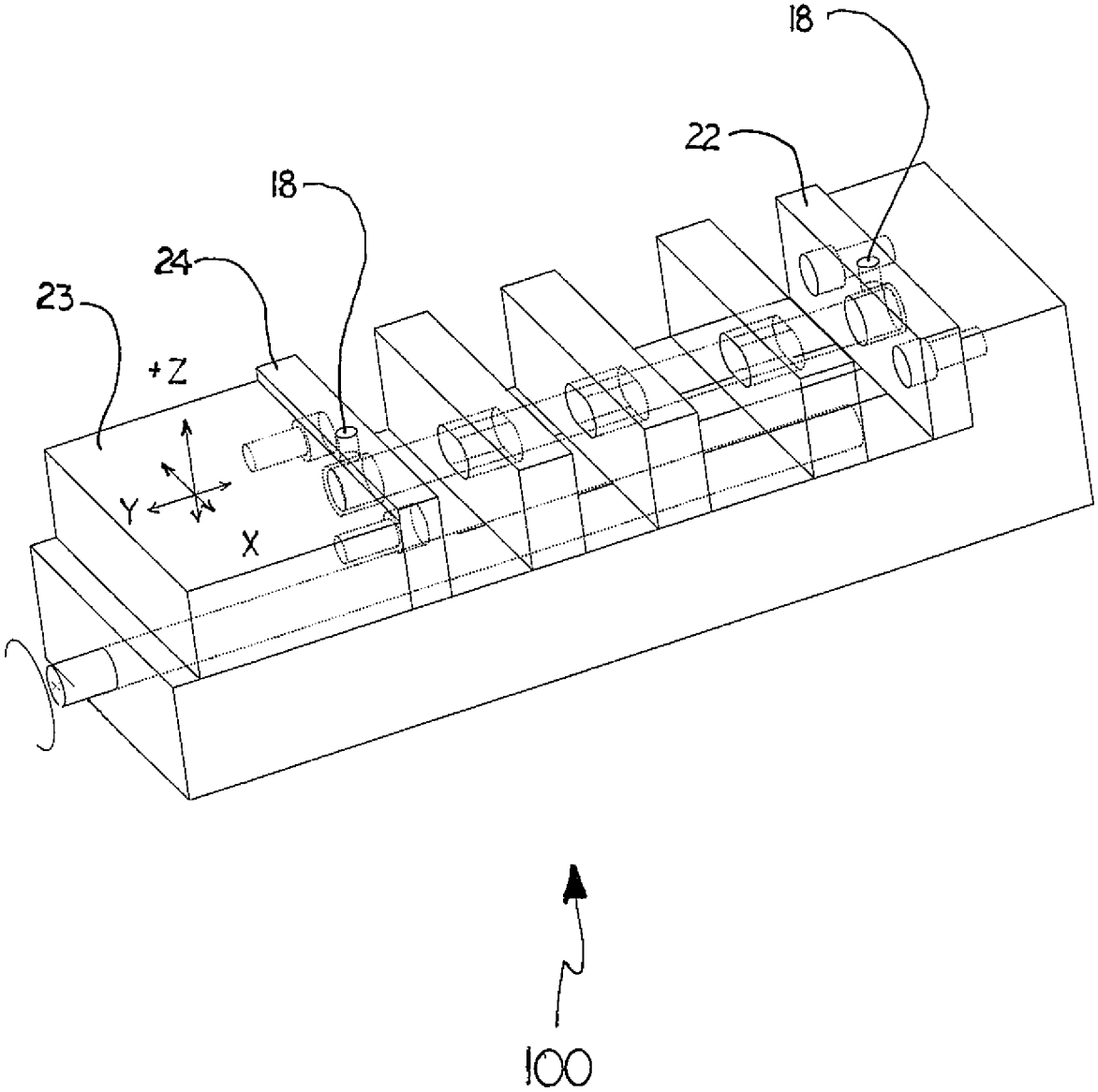
FIG. 12 is an isometric view of a typical workholding machinist vise including a single mounting pin floating jaw assembly according to FIG. 3 and showing another embodiment of the present invention where the force-down mechanism includes an adjusting screw threaded into the fixed jaw plate and the movable jaw plate to secure and release both ends of the mounting pin.

FIG. 12 is a further embodiment of a screw force-down mechanism in which screws 18 interacts with movable jaw plate 24 and fixed jaw plate 22. The adjusting screw threaded into the movable jaw plate may be a screw threaded into the mounting pin and held securely to the movable jaw 23 or movable jaw plate. Alternatively a non-adjusting means such as a pressed cross pin can be used, as well as other similar means known to those with skill in the art.

Figure 13A:
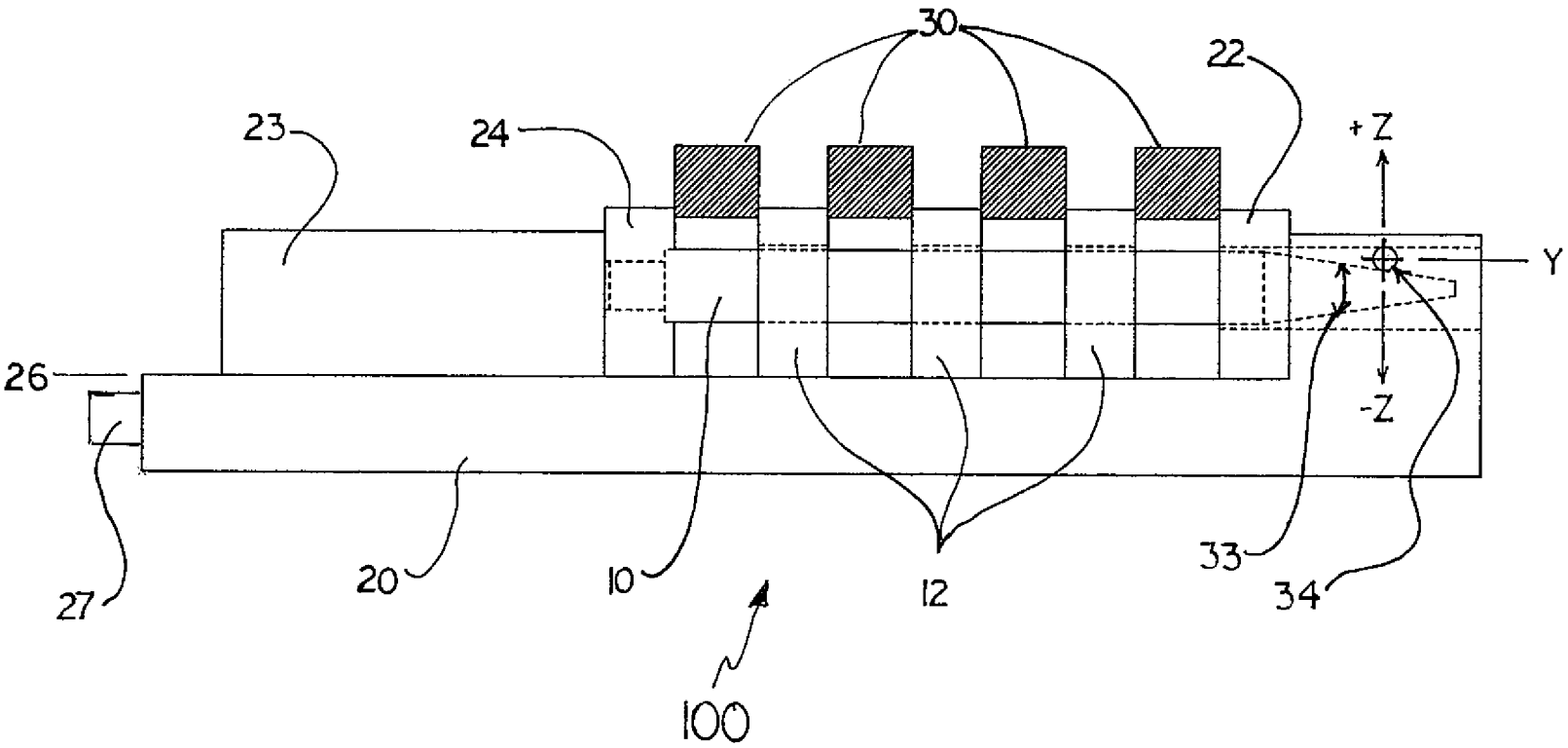
FIG. 13A is a side view of a typical workholding machinist vise holding workpieces with a single mounting pin floating jaw assembly according to FIG. 3 and showing another embodiment of the present invention where the force-down mechanism includes an adjustable wedge means for securing and releasing the free end of the mounting pin.
Figure 13B:
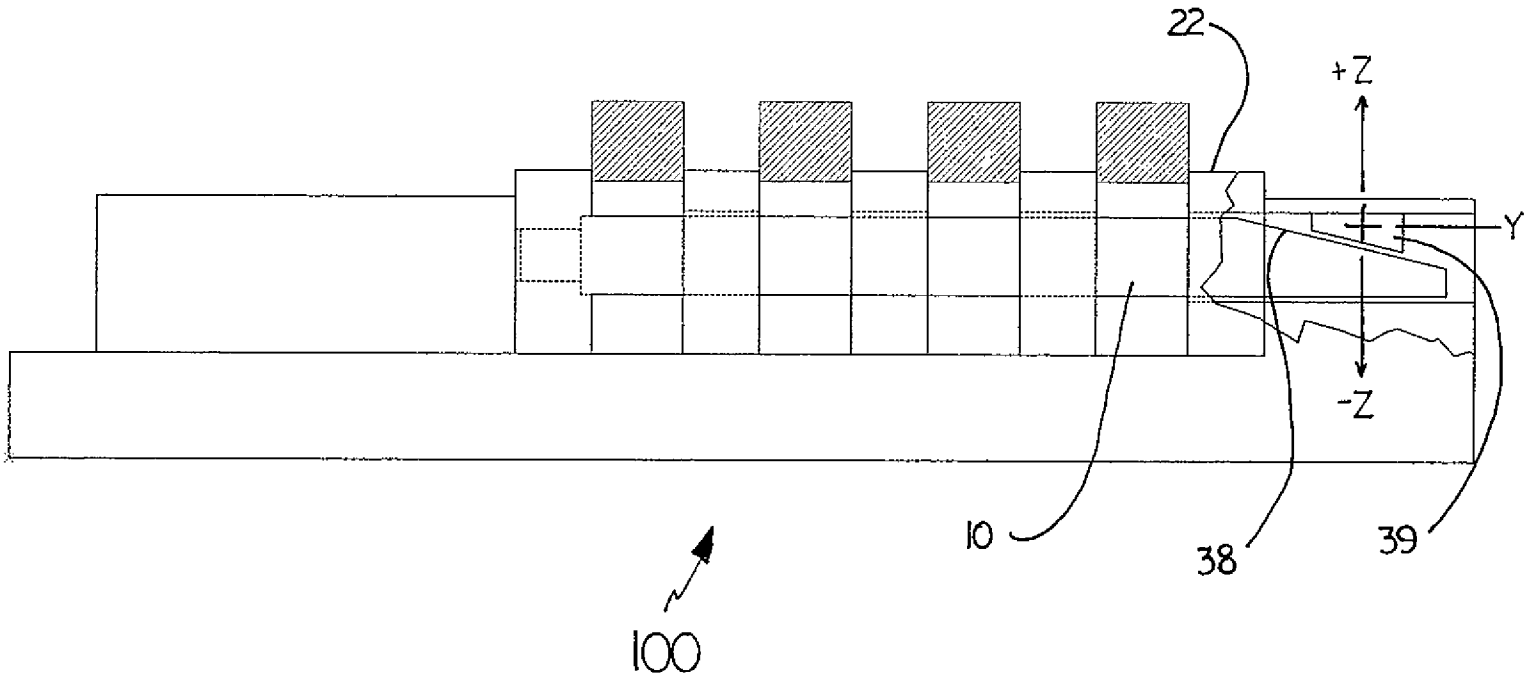
FIG. 13B is a side view of a typical workholding machinist vise holding workpieces with a single mounting pin floating jaw assembly according to FIG. 3 and showing another embodiment of the present invention where the force-down mechanism includes an adjustable wedge means for securing and releasing the free end of the mounting pin.

FIG. 13A shows another embodiment of a force-down mechanism that incorporates a wedge or included plane. FIG. 13A is a side view of a vise with mounting pin 10 and floating jaw plates 12 shown clamping workpieces 30. Mounting pin 10 employs an angular or inclined end 33 and dowel 34 (shown in end view). As known by those with skill in the art, dowel 34 can be adjusted in the +/−Y and Z directions and then locked in a desired location for dowel 34 to engage angular end 33 of mounting pin 10 at generally the same position along angular end 33 when clamping numerous sets of like workpieces. In this embodiment, dowel 33 forces free end of mounting pin 10 in the −Z direction, thereby forcing floating jaw plates 12 against ways 26. This embodiment thus eliminates the need to use a screw or screw/bracket force-down mechanism and eliminates the machinist from having to perform a second function as in tightening said screw 18 when clamping workpieces. Alternatively, as shown in FIG. 13B, the dowel 34 of FIG. 13A can be eliminated and/or replaced with an inclined block 39 that includes a flat angle that mates to a matching flat angle 38 at the free end of mounting pin 10 and replaces angular end 33 of FIG. 13A. In these embodiments, mounting pin 10 need only have an angled top surface. The force-down mechanism of FIGS. 13A and 13B can be incorporated into, without limitation, fixed jaw plate 22, movable jaw 23, movable jaw plate 24 and/or bracket 15 as shown in FIGS. 7-9. In this embodiment, the floating jaw assembly can be adjusted to accommodate workpieces of different dimensions by using floating jaw plates of different widths, using mounting pins of different lengths, and/or using other spacing means with the floating jaw plates.

Figure 14A:
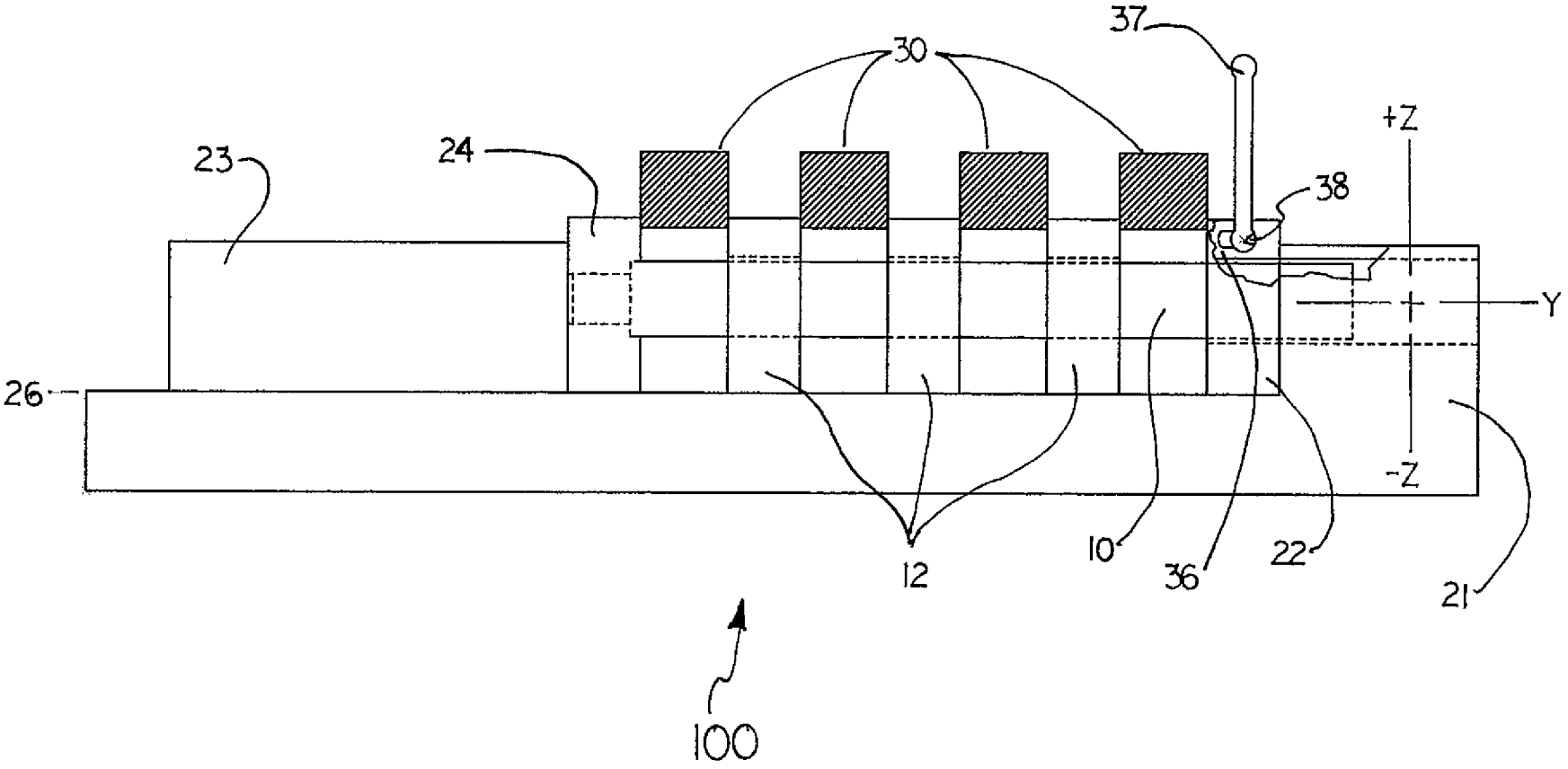
FIG. 14A is a side view of a typical workholding machinist vise holding workpieces with a single mounting pin floating jaw assembly according to FIG. 3 and showing another embodiment of the present invention where the force-down mechanism includes a cam with actuating lever at the free end of the mounting pin (the lever is shown in a pin released position).
Figure 14B:
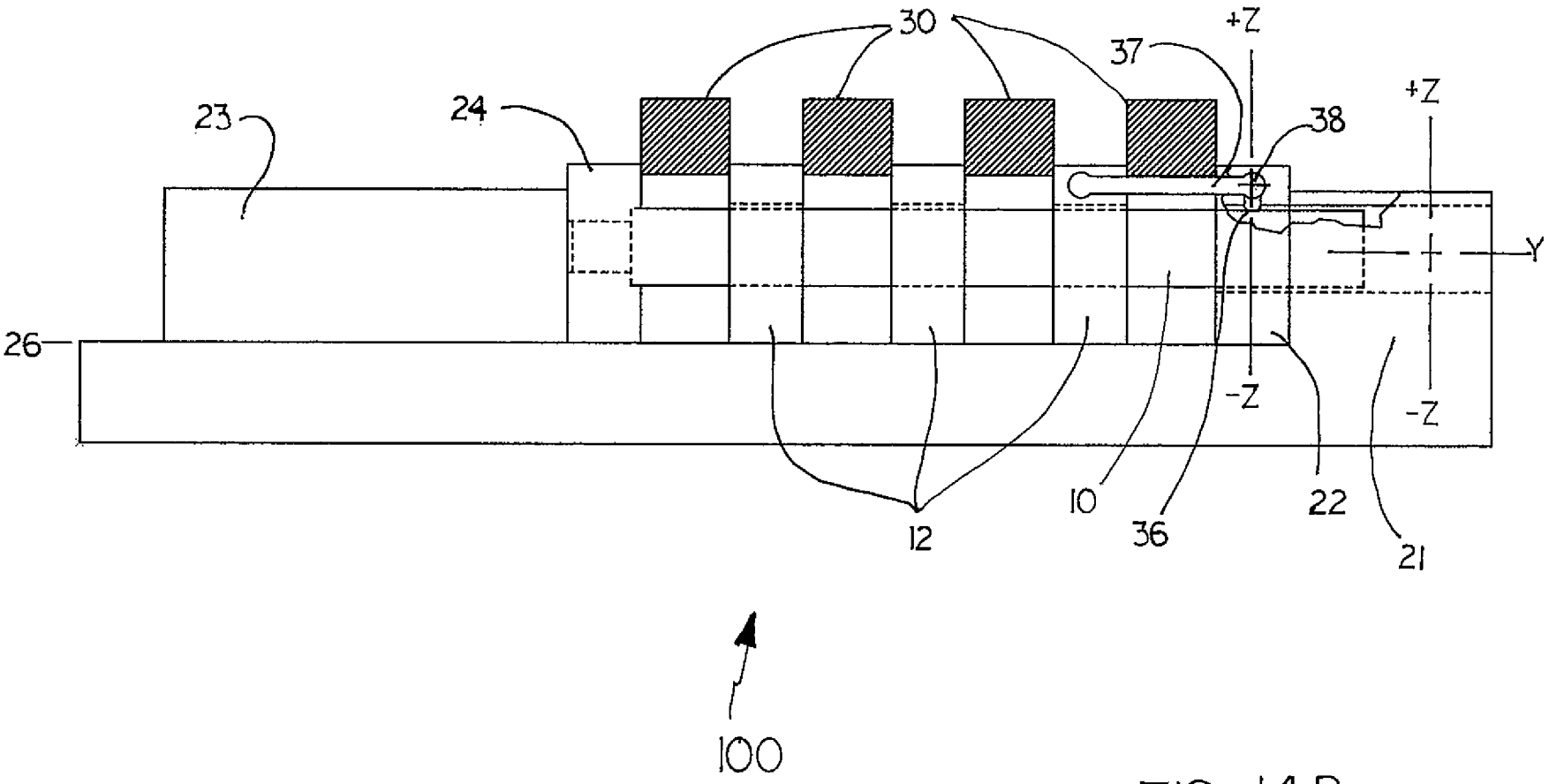
FIG. 14B is a side view of a typical workholding machinist vise holding workpieces with a single pin floating jaw assembly according to FIG. 3 and showing an embodiment of the present invention where the force-down mechanism includes a cam with actuating lever at the free end of the mounting pin (the lever is shown in a pin secured position).

FIGS. 14A and 14B show another embodiment of a force-down mechanism using a cam 36 residing above pin 10 and connected via a shaft to actuating lever 37 residing outwardly to the side of fixed jaw plate 22. This cam lever assembly is capable of pivoting around cam lever assembly axis 38 to release cam 36 from pin 10 allowing pin 10 to relax in the +Z direction as shown in FIG. 14A, or to apply a −Z directed force to pin 10 as shown in FIG. 14B. The cam lever assembly can be incorporated into, without limitation, floating jaw 21, movable jaw 23, movable jaw plate 24 and/or bracket 15 as shown in FIGS. 7-9.

Figure 15:
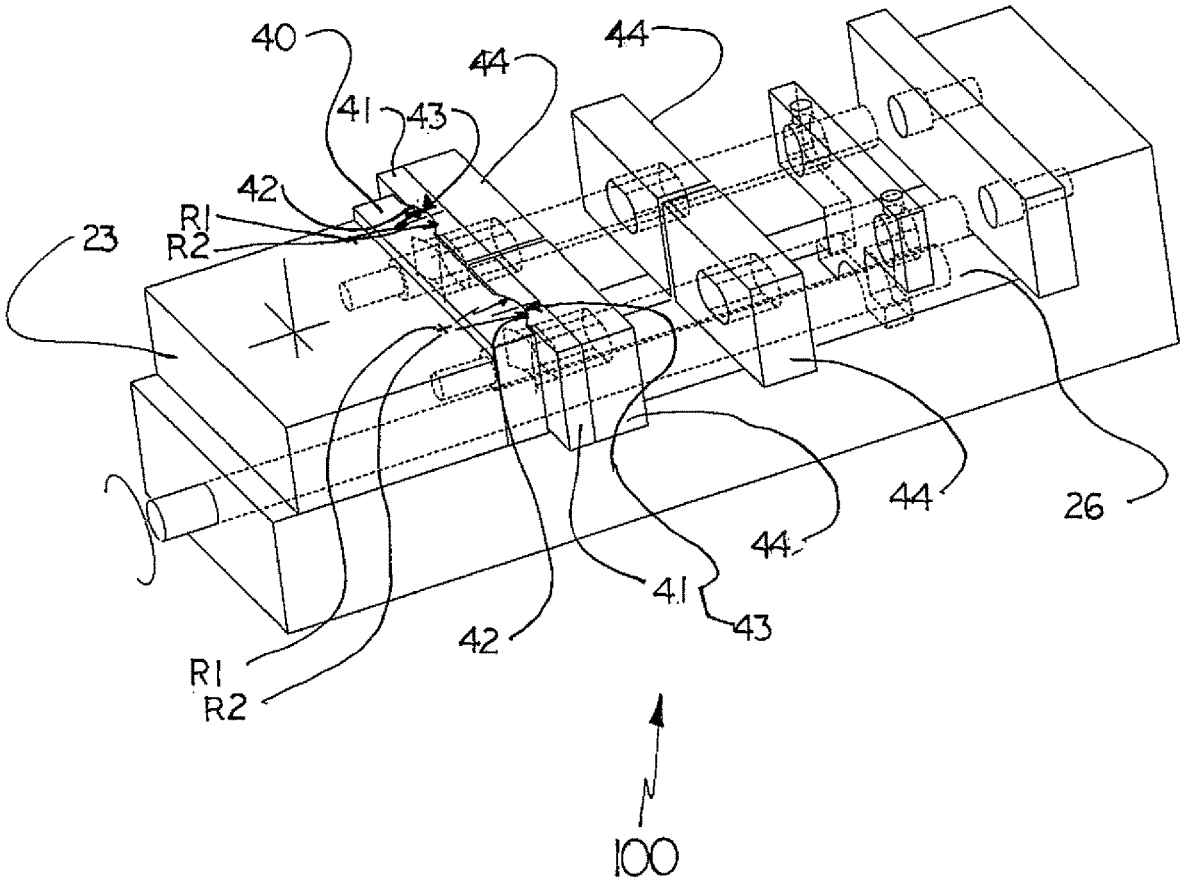
FIG. 15 is an isometric view of a typical workholding machinist vise with a two mounting pin floating jaw assembly according to FIG. 2 and showing another embodiment of the present invention further including a movable jaw plate with two curved surfaces that fit matching curved surfaces in an intermediate plate that interacts with an adjacent set of independent floating jaw plates (each mounting pin is associated with a separate floating jaw plate).

FIG. 15 shows another embodiment of the present invention, based generally on the configuration shown in FIG. 2, in which the movable jaw plate 24 of FIG. 2 is replaced with curved movable jaw plate 40 and interim plate 41, and floating jaw plate 12 of FIG. 2 is replaced with bisected floating jaw plates 44. Curved movable jaw plate 40 has two curved surfaces 42 which mate with curved surfaces 43 of an interim plate 41. The two mating curved surfaces of curved movable jaw plate 40 and interim plate 41 interact with bisected floating jaw plates 44, as positioned against the flat side of the interim plates 41, to offer the individual bisected floating jaw plates 44 the freedom of movement of the movable jaw 23 of FIG. 1; thus, doubling the amount of workpieces that can be held by a conventional matching vise as in FIG. 1 and the present invention in various embodiments. The bisected jaw plates have sufficient space between them to allow for such independent movement of each bisected floating jaw plate. Mating curved surfaces 42 and 43 of curved movable jaw plate 40 and interim plates 41, respectively, have mating Radii R1 and R2. Radii R1 and R2 are small enough so that the force generated by clamping workpieces will be sufficiently tangential to the curved surface so as to force the interim plates 41 to articulate around axes of radii R2 and thus accommodate the clamping needs of the workpieces. Additionally, Radii R1 and R2 are large enough so that the force generated by clamping workpieces will be distributed amongst the greatest area of the curved surfaces. Mating curved surfaces 42 and 43 can be the inverse of what is shown in FIG. 15 (that is the curved surfaces can be convex or concave on the jaw plate 40 and interim plate 41—so long as the opposing surfaces are mated). In this embodiment, the interim plate openings (hidden from view), through which mounting pins 10 pass, provide sufficient clearance as to not engage mounting pin 10 when clamping workpieces, such that interim plate 41 can move as needed.

Figure 16:
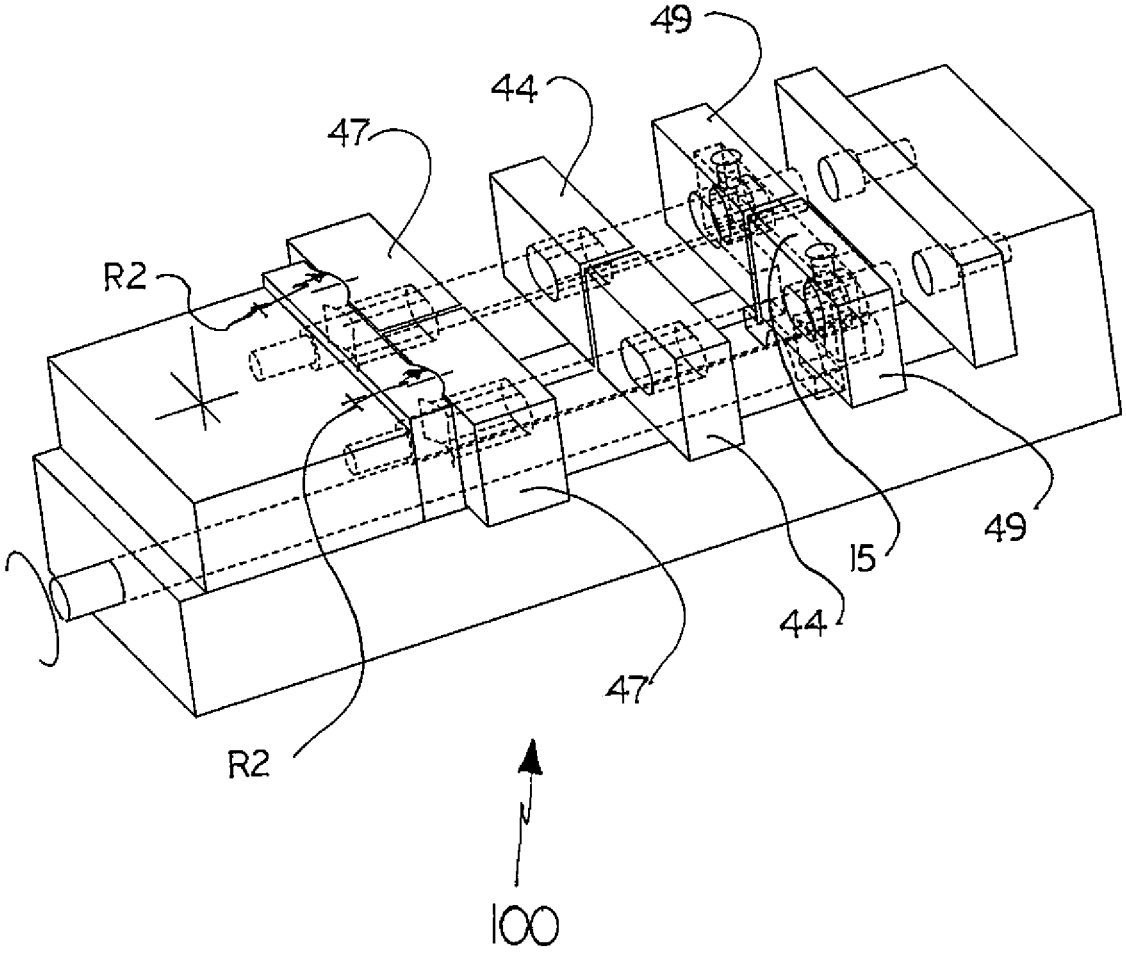
FIG. 16 is an isometric view of a typical workholding machinist vise with a two pin mounting bisected floating jaw assembly similar to FIG. 15 and showing another embodiment of the present invention further including separated or bisected floating jaw plates associated with each mounting pin and with the movable jaw plate having a curved surface that fits the matching curved surfaces in the adjacent set of floating jaw plates.
Figure 17:
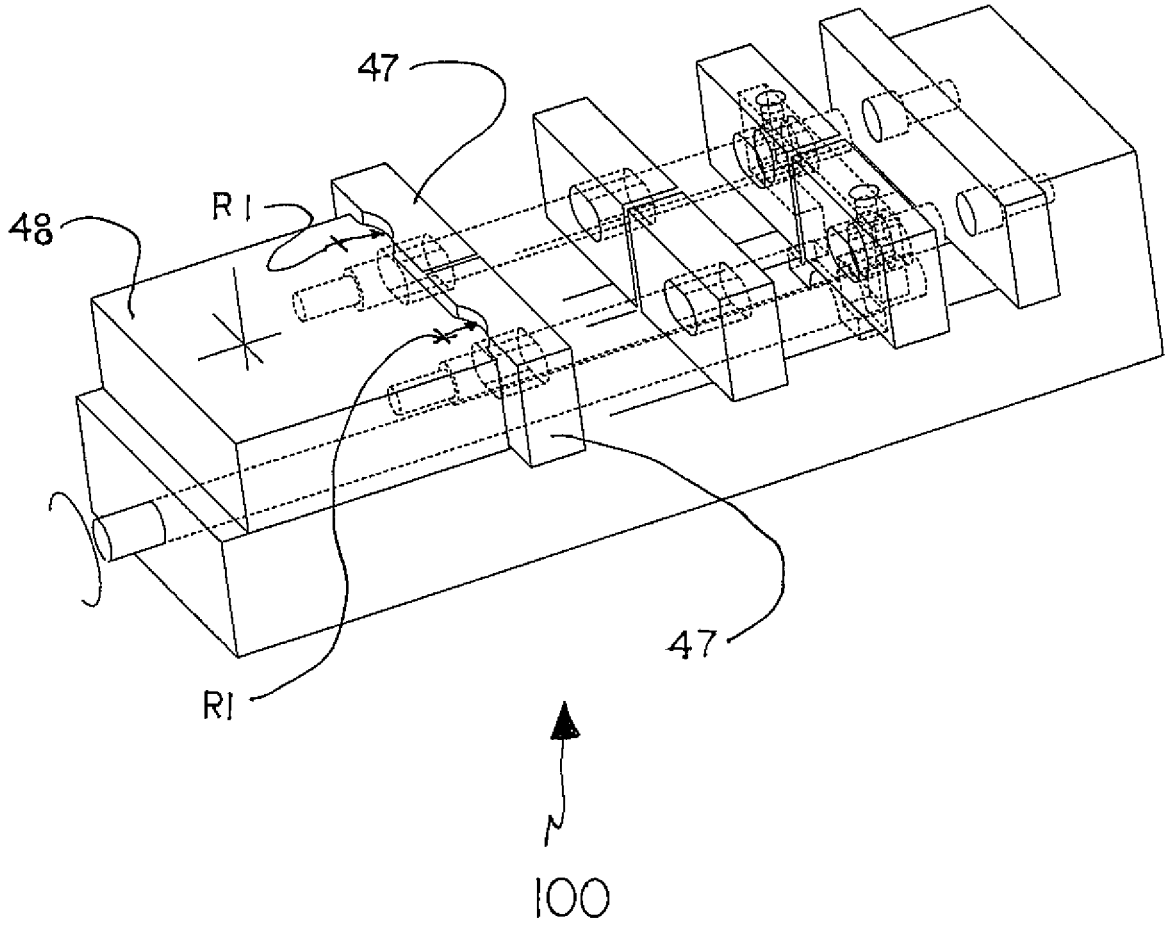
FIG. 17 is an isometric view of a typical workholding machinist vise including a two mounting pin bisected floating jaw assembly similar to FIG. 16 and showing another embodiment of the present invention further including separated or bisected floating jaw plates associated with each mounting pin and with the movable jaw having a curved surface that fits matching curved surfaces in the adjacent set of floating jaw plates.

FIGS. 16-17 depict further embodiments of the curved surface embodiment shown in FIG. 15. FIG. 16 eliminates interim plate 41 of FIG. 15 and incorporates mating radii R2 into curved bisected floating jaw plates 47, with floating jaw plates 49 having a machined cavity to receive bracket 15. FIG. 17 incorporates mating radii R1 of curved movable jaw plate of FIGS. 15 and 16 into curved movable jaw 48.

Figure 18:
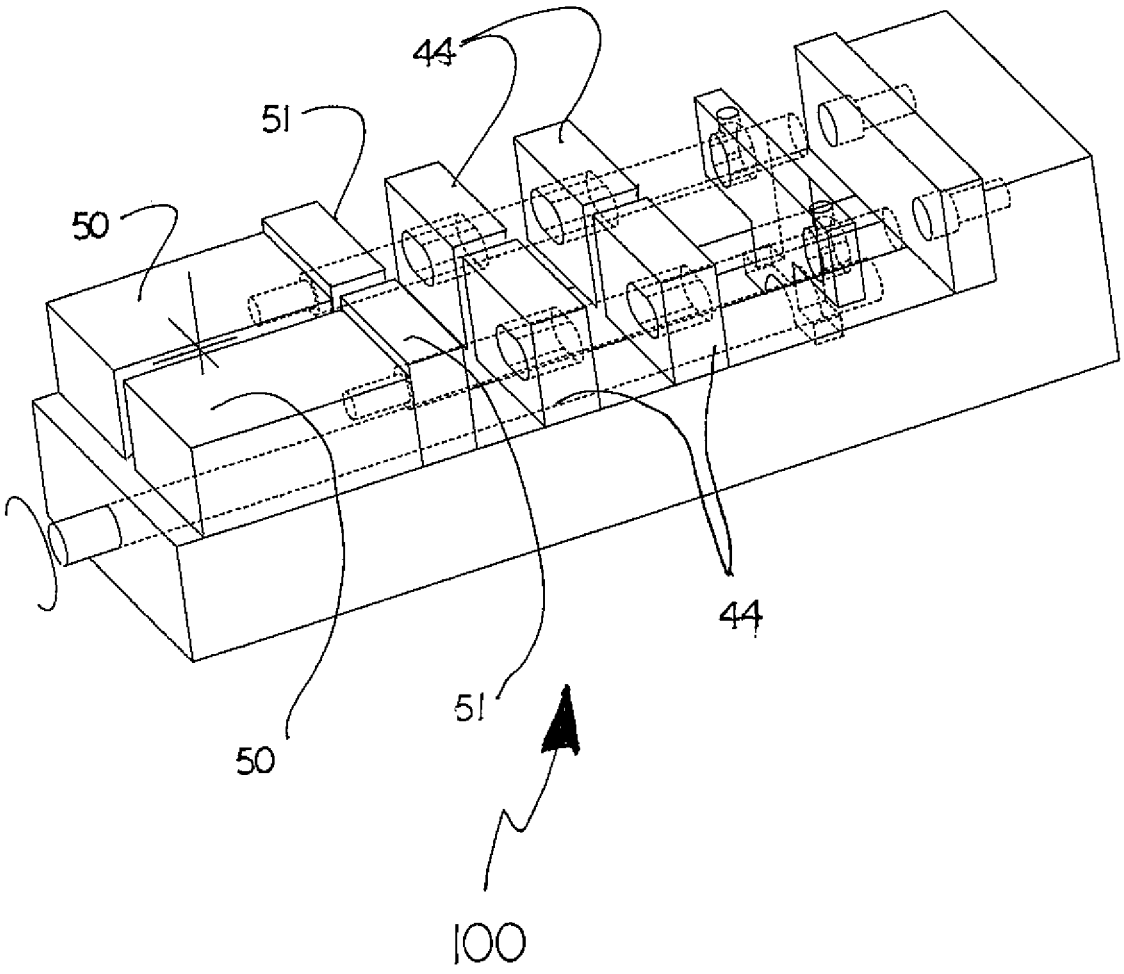
FIG. 18 is an isometric view of a typical workholding machinist vise including a two mounting pin bisected floating jaw assembly similar to FIG. 2 and showing another embodiment of the present invention further including separate or bisected floating jaw plates associated with each mounting pin and with a movable jaw that is bisected longitudinally where each bisected side of movable jaw can move independently of the other.

FIG. 18 continues with the teaching of doubling the effect of movable jaw 23 by creating two independently acting movable jaws 50 coupled to bisected movable jaw plates 51, which act upon bisected floating jaw plate 44.

Figure 19:
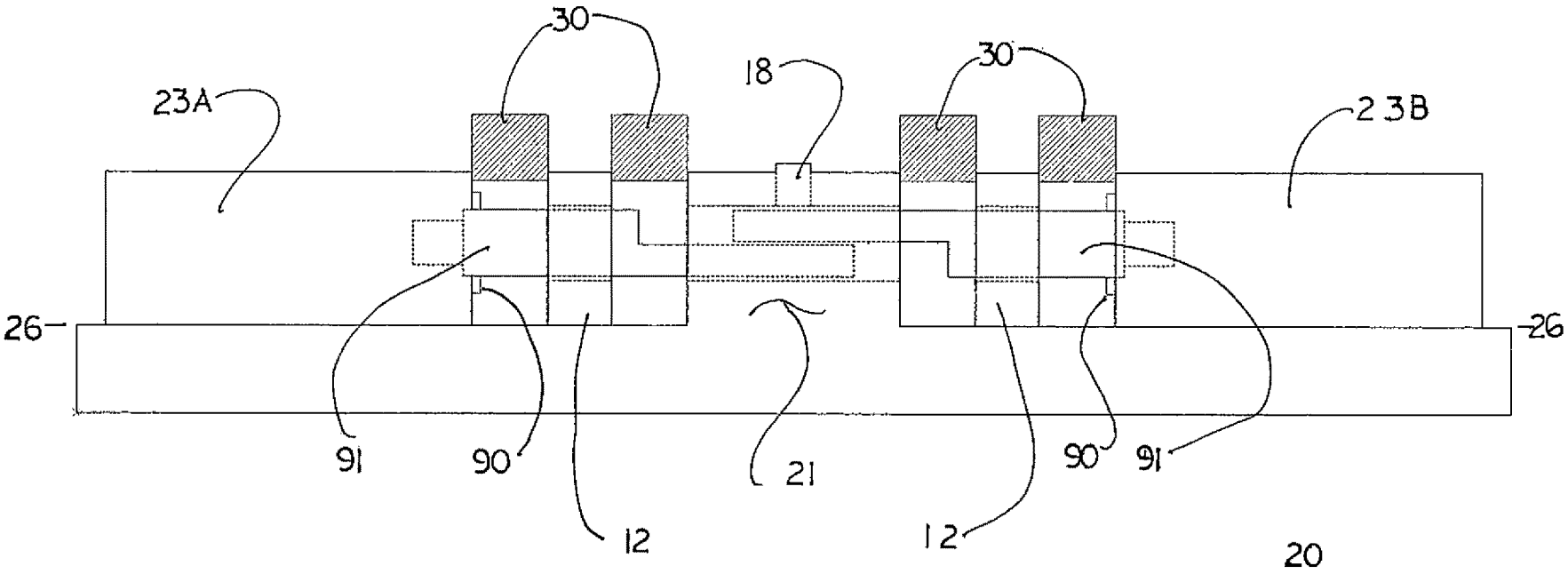
FIG. 19 is a side view of typical dual movable jaw machining vise including a one mounting pin floating jaw plate assembly similar to FIG. 3 added to work in cooperation with each of the two movable jaws of the vise.

FIG. 19 is a side view of a typical dual movable jaw vise with the floating jaw plate assembly invention incorporated therein. The assembly is shown holding up to two workpieces 30 between movable jaw 23A and floating jaw plate 12 attached to fixed jaw 21, and up to two workpieces 30 between movable jaw 23B and floating jaw plate 12 attached to fixed jaw 21. Two mounting pins 91 are affixed to the movable jaws 23A and 23B. Mounting pins 91 are relieved diametrically as to allow clearance for each pin to engage the same longitudinal through-hole in fixed jaw 21 cooperatively and further to allow free ends of both mounting pins 91 to be forced in the −Z direction by one adjusting screw 18 simultaneously; thus, forcing floating jaw plates against the ways 26. Additionally, this embodiment anticipates other means, including but not limited to, allowing two mounting pins 91 to cooperatively occupy one through-hole in fixed jaw 21, similar to one mounting pin with a smaller diameter fitting or telescoping into hollow mounting pin, and other means that force both mounting pins simultaneously in the −Z direction by a single mechanism.

Figure 20:
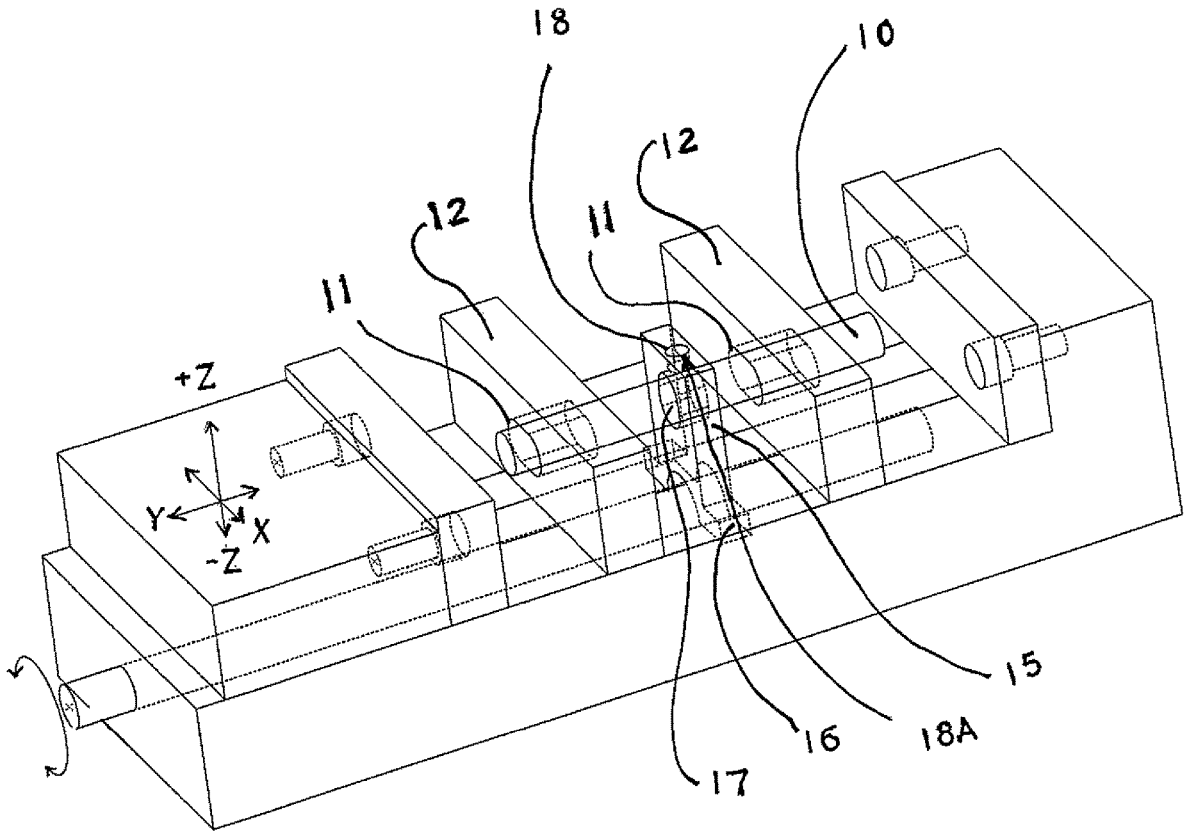
FIG. 20 is an isometric view of a typical workholding machinist vise including a mounting pin floating jaw assembly and showing an embodiment of the present invention where the force-down mechanism includes a bracket with adjusting screw to secure and release the mounting pin.

FIG. 20 shows a bracket 15 comprised of openings 12 of greater diameter than pin(s) 10 to allow pin to move in the −Z direction with respect to bracket 15 and ears 16 that interact with the underside of the way 26 so as to be pulled up to a stop in the +Z direction when tightening screws 18 are engaged. In particular, screws 18 are tightened after clamping workpieces between jaws, which, in turn, forces the mounting pin(s) 10 in the −Z direction and thus aids in forcing floating jaw plates 12 against ways 26. At the conclusion of machining workpieces, screws 18 are loosened before unclamping workpieces to eliminate the −Z directed force on pin(s) 10 and to allow freedom to move movable jaw 23 and affixed items longitudinally in the Y direction. Bracket 15 with ears 16 allow for varying positioning in the +/−Y. The present invention does not limit a multitude of means to connect said bracket 15 to any stationary portion of the vise the present invention does not limit the quantity of floating jaw plate(s) that can be held and it is understood that any combination or quantity of force down mechanisms can be used to secure a multitude of floating jaw plate(s) in the −Z direction.

Figure 21:
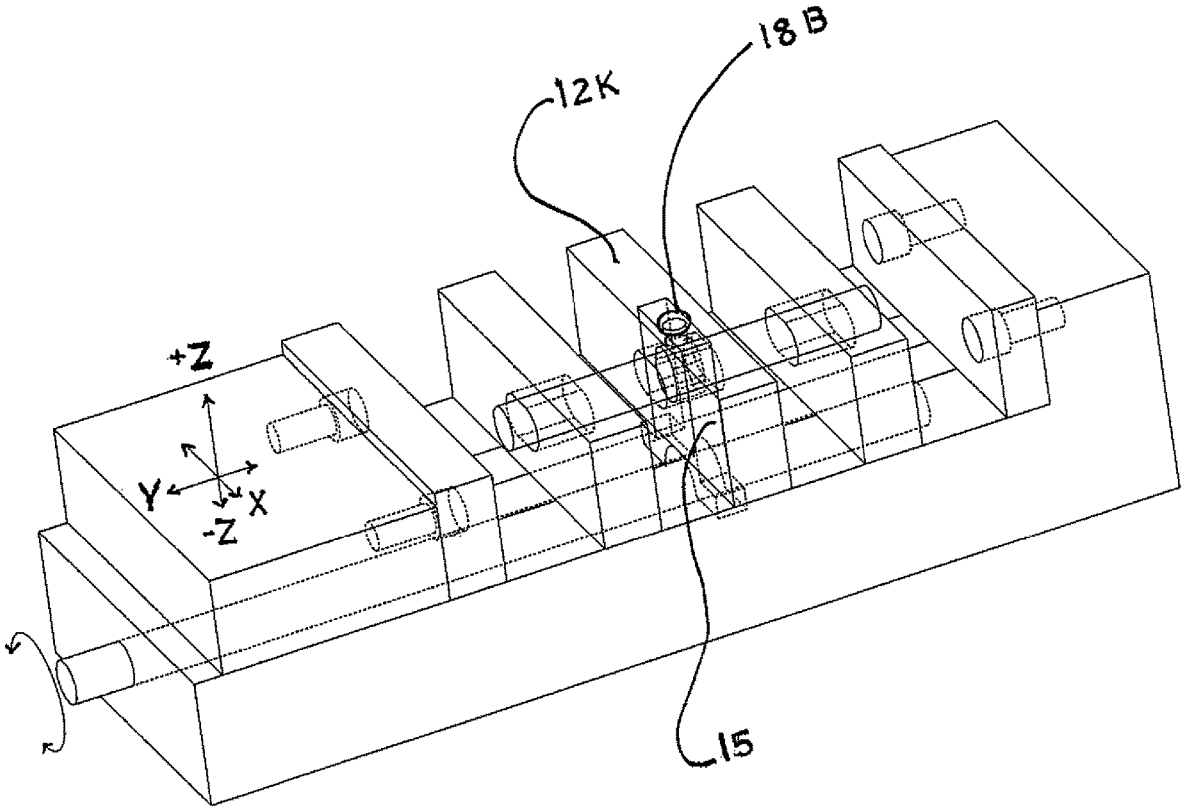
FIG. 21 is an isometric view of a typical workholding machinist vise including a mounting pin floating jaw assembly and showing another embodiment of the present invention where the force-down mechanism includes a bracket screw assembly fitted into a floating jaw.

FIG. 21 shows another embodiment of a screw/bracket force-down mechanism, with floating jaw plate 12*k* having a machined cavity to receive bracket 15. This embodiment hides bracket 15 from the work area. The present invention does not limit the quantity of floating jaw plate(s) that can be held and it is understood that any combination or quantity of force down mechanisms can be used to secure a multitude of floating jaw plate(s) in the −Z direction.

Figure 22:
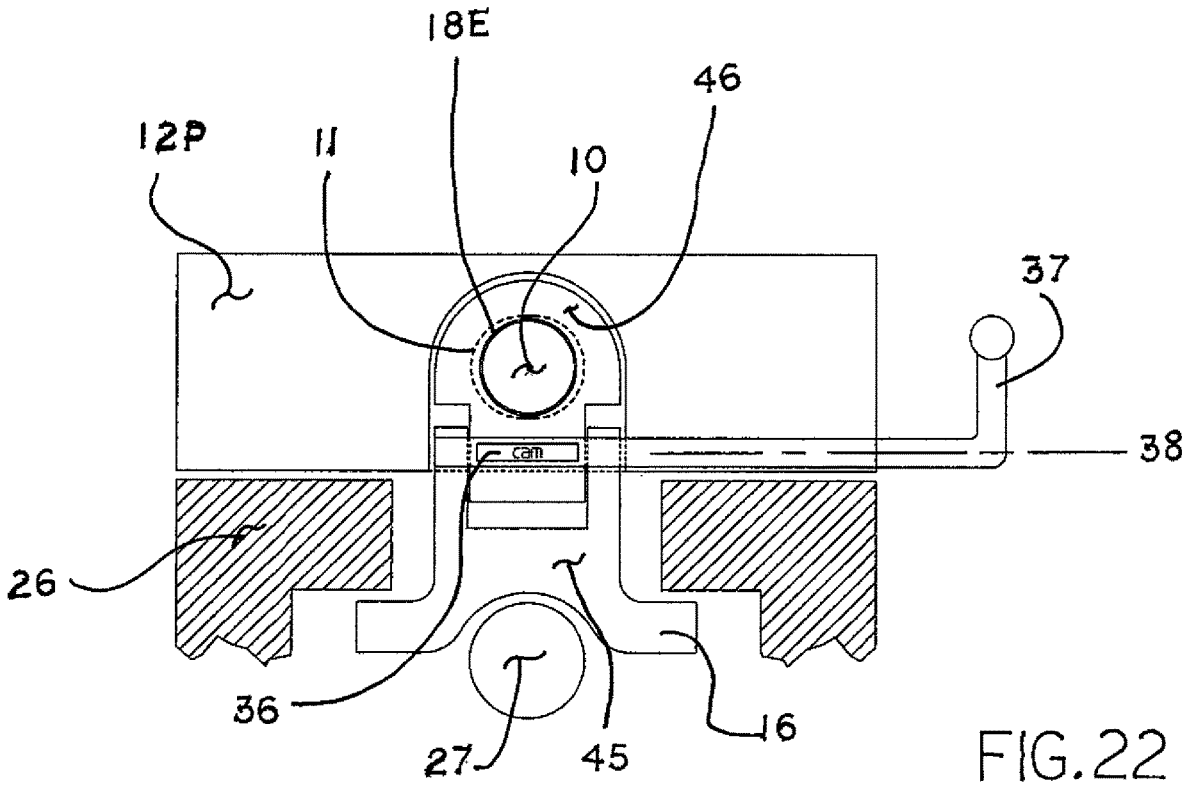
FIG. 22 is a front a mounting pin floating jaw assembly and showing another embodiment of the present invention where the force-down mechanism includes a cam with actuating lever (the lever is shown in a pin released position).
Figure 23:
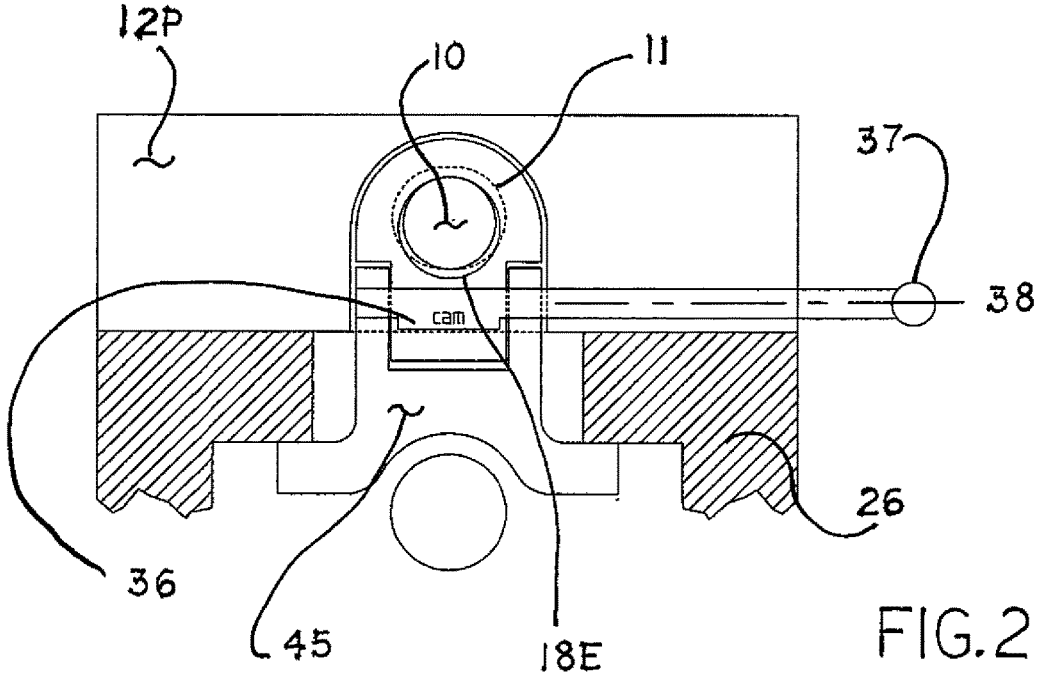
FIG. 23 is a front view of a mounting pin floating jaw assembly and showing an embodiment of the present invention where the force-down mechanism includes a cam with actuating lever (the lever is shown in a pin secured position).
Figure 24:
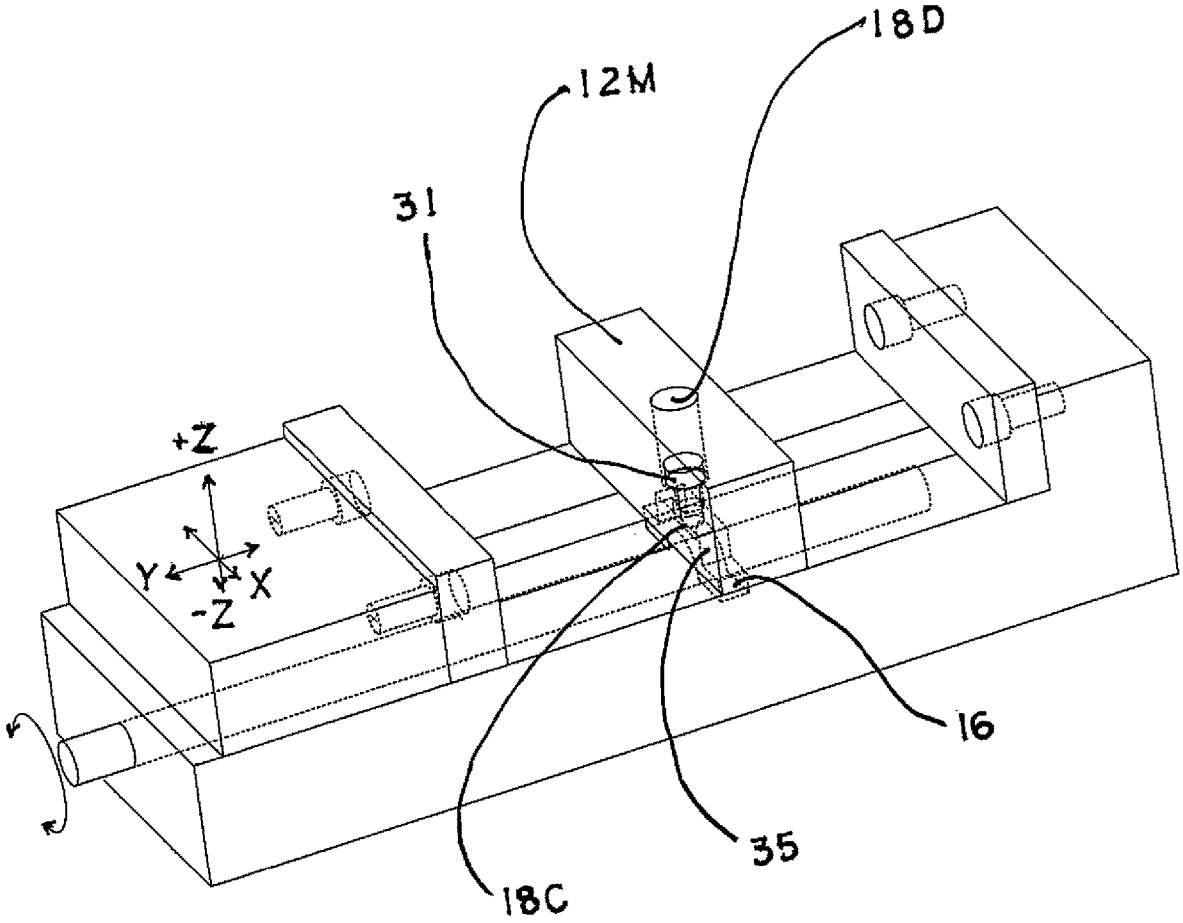
FIG. 24 is an isometric view of a floating jaw assembly resting on the ways of the vise and showing another embodiment of the present invention where the force-down mechanism includes a bracket screw assembly whereas the screw is positioned and is capable to apply force to at least one floating jaw plate(s) directly, eliminating the pin.
Figure 25:
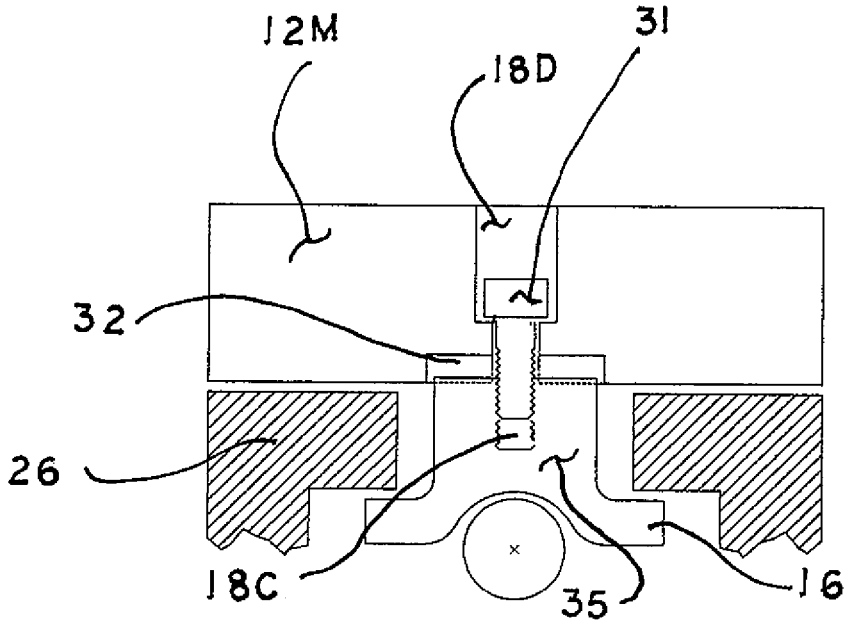
FIG. 25 is a front view of a floating jaw assembly resting on the ways of the vise and showing another embodiment of the present invention where the force-down mechanism includes a bracket screw assembly whereas the screw is positioned and is capable to apply force to at least one floating jaw plate(s) directly, eliminating the pin. (the view depicts the released position)
Figure 26:
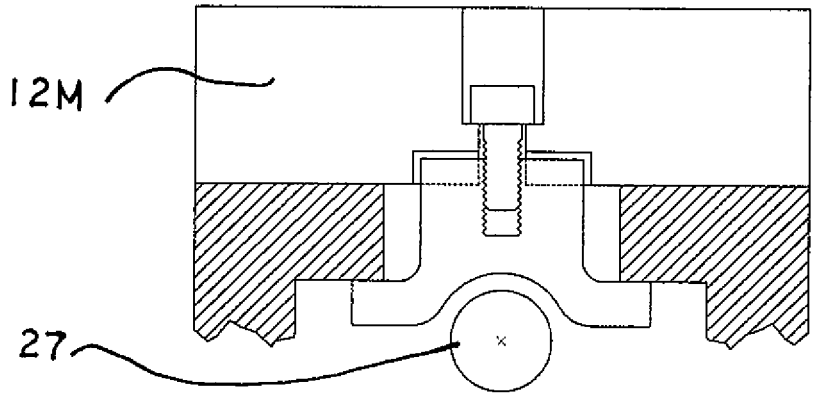
FIG. 26 is a front view of a floating jaw assembly resting on the ways of the vise and showing another embodiment of the present invention where the force-down mechanism includes a bracket screw assembly whereas the screw is positioned and is capable to apply force to at least one floating jaw plate(s) directly, eliminating the pin. (the view depicts the secured position)
Figure 27:
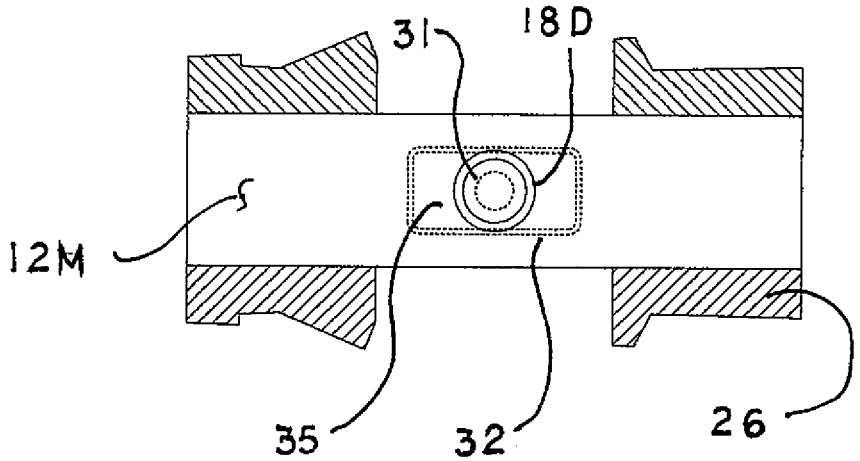
FIG. 27 is a top view of a floating jaw assembly resting on the ways of the vise and showing another embodiment of the present invention where the force-down mechanism includes a bracket screw assembly whereas the screw is positioned and is capable to apply force to at least one floating jaw plate(s) directly, eliminating the pin.

FIGS. 22 and 23 show another embodiment of a force-down mechanism comprising of a cam 36 connected via a shaft to actuating lever 37 residing outwardly to the side of floating jaw plate 12P and bracket component 45 with opening 18E and bracket component 46. The cam lever assembly is capable of pivoting around cam lever assembly axis 38 to release cam 36 from bracket component 46 with opening 18E allowing bracket component 45 to relax in the −Z direction and pin 10 and floating jaw plate 12P to relax in the +Z direction as shown in FIG. 22, or to apply a −Z directed force to pin 10 as shown in FIG. 23. The cam lever assembly cooperates with the pin 10 which in turn can relax or force floating jaw plate(s) 12 against the at least one vise way 26, therefore said force down mechanism may reside outside of and be unaffiliated with floating jaw plate(s) 12P in the same fashion as the force down mechanism shown in FIG. 20. The cam lever assembly can be incorporated into, without limitation, any floating jaw plate(s), movable jaw 23, movable jaw plate 24, fixed jaw 21, fixed jaw plate 22 and/or bracket.

FIGS. 24-29 show the present invention can include various force-down mechanisms that force the floating jaw plate(s) 12M and 12W securely against the base or ways 26 of vise 100 that do not require a pin. Additionally, the present invention anticipates and is not limited to any means that secure any floating jaw plate(s) to any Z datum available.

FIGS. 24-27, comprised of bracket 35 with screw 31, opening 18C, and ears 16 that interact with the underside of the way 26 so as to be pulled up to a stop in the +Z direction when screw 31 is engaged. In particular, screw 31 is engaged when clamping workpieces between jaws, which, in turn, forces floating jaw plate(s) 12M comprised of opening 18D and recess 32 against ways 26. At the conclusion of machining workpieces, screw 31 can be loosened to eliminate the −Z directed force on floating jaw plate(s) 12M to allow freedom to move floating jaw plate(s) 12M. Bracket 35 with ears 16 allow for varying positioning in the +/−Y direction to accommodate various sizes of workpieces and thus various positions of floating jaw plate(s) 12M. Floating jaw plate(s) with recess 32 can engage bracket 35 to aid positioning of bracket 35 relative to floating jaw plate(s) to facilitate the tightening and loosening of screw 31 and the positioning and slidability of the force down mechanism. The present invention does not limit a multitude of means to comprise said engagement of bracket 35 with floating jaw plate(s) 12M. The present invention is not limited to the inclusion or use of recess 32 in floating jaw plate(s) or any said engagement of floating jaw plate(s) 12M with bracket 35. The present invention does not limit a multitude of means to connect said bracket 35 to any stationary portion of the vise.

Figure 28:
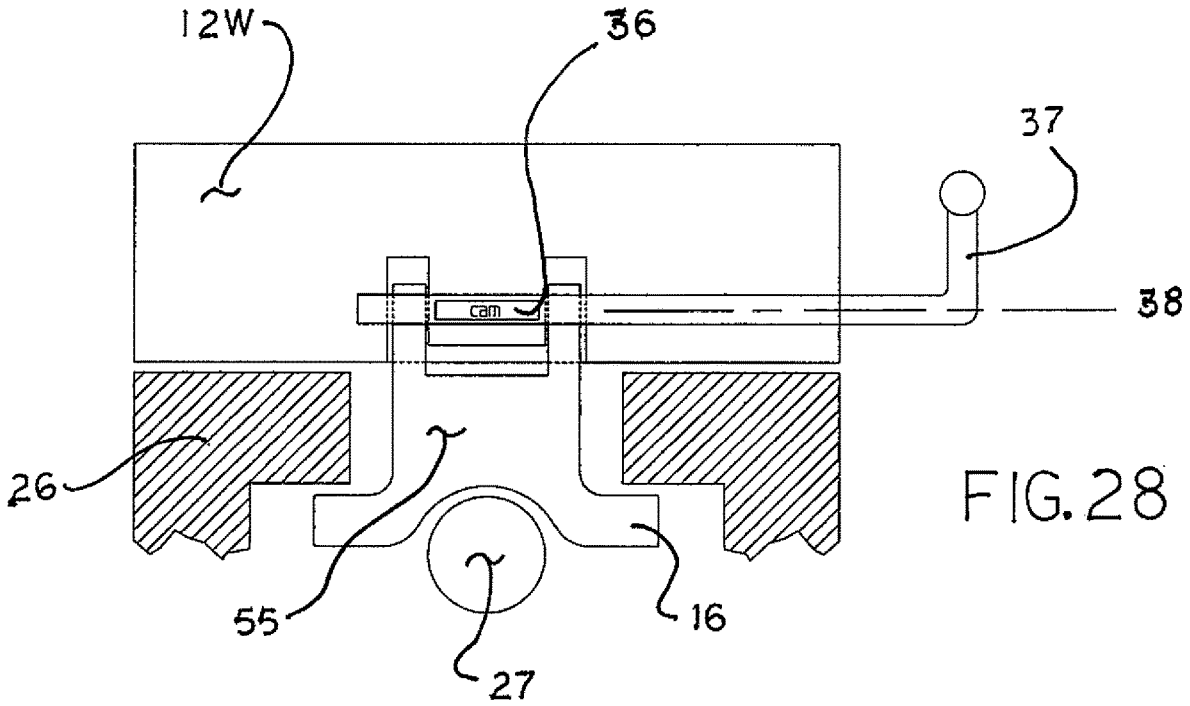
FIG. 28 is a front view of a floating jaw assembly resting on the ways of a vise and showing an embodiment of the present invention where the force-down mechanism includes a cam with actuating lever. (the lever is shown in a pin relaxed position).
Figure 29:
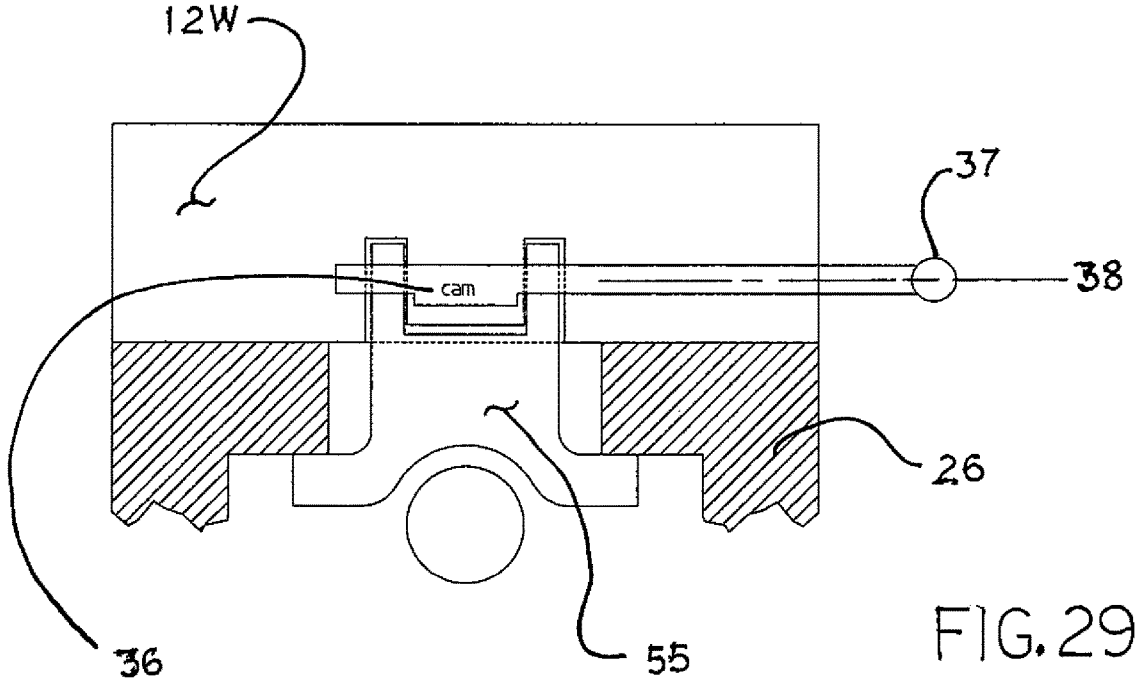
FIG. 29 is a front view of a floating jaw assembly resting on the ways of a vise and showing an embodiment of the present invention where the force-down mechanism includes a cam with actuating lever (the lever is shown in a pin secured position).

FIGS. 28 and 29 show another embodiment of a force-down mechanism comprising of a cam 36 connected via a shaft to actuating lever 37 residing outwardly to the side of floating jaw plate 12W and bracket 55. The cam lever assembly is capable of pivoting around cam lever assembly axis 38 to release cam 36 from floating jaw plate(s) 12W allowing floating jaw plate(s) 12W to relax in the +Z direction as shown in FIG. 10 or to apply a −Z directed force floating jaw plate(s) 12W as shown in FIG. 11. The cam lever assembly is not limited to any means or points of connection to floating jaw plate(s) or vise 100.

Within the scope of the present invention, the components of the invention such as, but not limited to, fixed jaw plate 22, movable jaw plate 24, mounting pin 10, floating jaw plate(s) 12, 12K, 12P, 12M, 12W, brackets 15, 35, 45, 46, 55 screws 18, 31, cam 36, actuating lever 37 can be made from a variety of materials such as steels, aluminum, plastics, composites, ceramics, etc.

In view of the above, it will be seen that the several objects of the invention are achieved and other advantageous results attained. As various changes could be made in the above method of play without departing from the scope of the invention, it is intended that all matter contained in the above description or shown in the accompanying drawings shall be interpreted as illustrative and not in a limiting sense.

What is claimed is:

1. A machinist vise assembly capable of holding a plurality of individual work pieces, and comprising a base with at least one vise way, a fixed jaw mounted on the least one way, at least one movable jaw slidably mounted on the at least one vise way to move toward and away from the fixed jaw on a longitudinal axis in such a manner that at least one workpiece can be securely held between the fixed jaw and the at least one movable vise jaw, and a mechanism for moving the at least one movable jaw toward and away from the fixed jaw to clamp and unclamp workpieces; and a floating jaw assembly comprising at least one mounting pin with a first end and second end with said first end and second end of the at least one mounting pin not secured to any component of the machinist vise assembly and at least one floating jaw plate with an opening corresponding and positioned to receive each at least one mounting pin for slidably mounting the at least one floating jaw plate between the fixed jaw and at least one movable jaw and for articulating movement of the at least one floating jaw plate in a plane substantially parallel to the at least one way of the vise assembly and about a vertical axis perpendicular to the longitudinal axis of the vise assembly so that the floating jaw plate interacts with adjacent fixed jaw or the adjoining at least one movable jaw and or at least one additional floating jaw to adjust to and securely hold a plurality of individual work pieces.

2. The vise assembly of claim 1, wherein the floating jaw assembly is an accessory that can be attached to an existing vise assembly.

3. The vise assembly of claim 1 or 2 wherein the floating jaw assembly further comprises a means of forcing the at least one floating jaw plate downward and securely against the at least one way of the vise assembly.

4. The vise assembly of claim 3, wherein the means of forcing the at least floating jaw plate downward and securely against the at least one way of the vise assembly comprises a bracket and screw clamp assembly comprising a bracket having at least one opening corresponding and positioned to receive the at least one mounting pin and a lower holding means for slidably engaging with the vise base along the longitudinal axis of the vise and for securely holding the bracket against the vise base; and a screw positioned to interact with a threaded opening in the bracket in a manner to force the at least one mounting pin downward and, in cooperation with the at least one mounting pin, the at least one floating jaw plate toward the vise base when the screw is turned downward.

5. The vise assembly of claim 3, wherein the means of forcing the at least one floating jaw plate downward and securely against the at least one way of the vise assembly comprises a cam and lever assembly that forces the at least one mounting pin downward and at least one floating jaw plate securely against ways when cam and lever assembly is engaged and relaxes said forces on at least one mounting pin and at least one floating jaw plate when not engaged.

6. An assembly comprising two or less components that secure and release at least one floating jaw plate to a vise assembly wherein at least one floating jaw plate contains means for articulating movement of the at least one floating jaw plate in a plane substantially parallel to the at least one way of a vise assembly and about a vertical axis perpendicular to the longitudinal axis of the vise assembly so that the floating jaw plate interacts with an adjacent fixed jaw or an adjoining at least one movable jaw or at least one additional floating jaw to adjust to and securely hold a plurality of individual work pieces.

7. The assembly of claim 6 wherein the two or less components are a bracket and a screw.

8. The assembly of claim 6 wherein the two or less components are a bracket and a cam.

9. A machinist vise assembly capable of holding a plurality of individual workpieces, and comprising a base with at least one vise way, a fixed jaw mounted on the at least one vise way, at least one movable jaw slidably mounted on the at least one vise way to move toward and away from the fixed jaw on a longitudinal axis in such a manner that at least one workpiece can be securely held between the fixed jaw and the at least one movable jaw, and a mechanism for moving the movable jaw toward and away from the fixed jaw to clamp and unclamp workpieces; and at least one floating jaw assembly comprising a floating jaw plate and two or less components that when engaged force and securely hold at least one floating jaw plate to the vise assembly and when said two or less components are not engaged allow for adjustable movement of the at least one floating jaw assembly along the longitudinal axis of the vise assembly and for articulated movement of the at least one floating jaw assembly in a plane substantially parallel with the at least one vise way of the vise assembly and about a vertical axis perpendicular with the at least one vise way of the vise assembly so that the at least one floating jaw assembly can, in cooperation with an adjoining jaw or the adjoining at least one movable jaw and or the at least one floating jaw assembly adjust to and securely hold workpieces.

10. The vise assembly of claim 9, wherein the floating jaw assembly is an accessory that can be attached to an existing vise assembly.

11. The two or less components of claim 9 are a bracket and a screw.

12. The two or less components of claim 9 are a bracket and a cam.

* * * * *